US006519318B1

(12) United States Patent
Andrews

(10) Patent No.: US 6,519,318 B1
(45) **Date of Patent: *Feb. 11, 2003**

(54) LARGE SURFACE AREA X-RAY TUBE SHIELD STRUCTURE

(75) Inventor: Gregory C. Andrews, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 64 days.

This patent is subject to a terminal disclaimer.

(21) Appl. No.: 09/656,076

(22) Filed: Sep. 7, 2000

Related U.S. Application Data

(63) Continuation-in-part of application No. 09/351,579, filed on Jul. 12, 1999.

(51) Int. Cl.[7] ..... H01J 35/10

(52) U.S. Cl. ..... 378/141; 378/121; 378/119; 378/130

(58) Field of Search ..... 378/141, 121, 378/119, 130

(56) References Cited

U.S. PATENT DOCUMENTS

| | | | | |
|---|---|---|---|---|
| 4,115,697 A | | 9/1978 | Hounsfield et al. | 250/445 T |
| 4,622,687 A | * | 11/1986 | Whitaker et al. | 313/30 |
| 4,709,559 A | | 12/1987 | Dotzauer et al. | 62/499 |
| 5,018,181 A | | 5/1991 | Iversen et al. | 378/144 |
| 5,541,975 A | * | 7/1996 | Anderson et al. | 378/130 |
| 5,689,542 A | * | 11/1997 | Lavering et al. | 378/130 |
| 5,737,387 A | | 4/1998 | Smither | 378/130 |
| 6,002,745 A | | 12/1999 | Miller et al. | 378/128 |
| 6,074,092 A | | 6/2000 | Andrews | 378/200 |
| 6,115,454 A | * | 9/2000 | Andrews et al. | 378/140 |
| 6,125,169 A | | 9/2000 | Wandke et al. | 378/143 |
| 6,252,934 B1 | * | 6/2001 | Scott et al. | 165/164 |
| 6,366,642 B1 | * | 4/2002 | Andrews | 378/130 |

* cited by examiner

*Primary Examiner*—David P. Porta
*Assistant Examiner*—Pamela R. Hobden

(57) ABSTRACT

An improved x-ray tube cooling system is disclosed. The system utilizes a shield structure that is connected between a cathode cylinder and an x-ray tube housing and is disposed between the electron source and the target anode. The shield includes a plurality of cooling fins to improve overall cooling of the x-ray tube and the shield so as to extend the life of the x-ray tube and related components. When immersed in a reservoir of coolant fluid, the fins facilitate improved heat transfer by convection from the shield to the to the coolant fluid. The cooling effect achieved with the cooling fins is further augmented by a convective cooling system provided by a plurality of fluid passageways formed within the shield, which are used to provide a fluid path to the coolant. In particular, a cooling unit takes fluid from the reservoir, cools the fluid, then circulates the cooled fluid through the fluid passageways. One or more depressions of "V" shaped cross section defined on the surfaces of the fluid passageways serve to facilitate nucleate boiling of the coolant in the passageway, and thereby materially increase the heat flux through the passageway to the coolant. Additionally, one or more extended surfaces disposed on the surfaces of the fluid passageways also facilitate a relative increase in the rate of heat transfer from the shield structure to the coolant. After flowing through the fluid passageway, the coolant is then discharged from the fluid passageways and directed over the cooling fins. In some embodiments, the fluid passageways are oriented so as to provide a greater heat transfer rate in certain sections of the shield than in other sections. Also disclosed is an improved braze joint for connecting the shield to the x-ray tube housing.

41 Claims, 12 Drawing Sheets

LARGE SURFACE AREA X-RAY TUBE SHIELD STRUCTURE

CONTINUATION-IN-PART APPLICATION

This application is a Continuation-In-Part of U.S. patent application Ser. No. 09/351,579, entitled "X-RAY TUBE COOLING SYSTEM," and filed 12 Jul. 12, 1999. The aforementioned United States Patent Application is incorporated herein in its entirety by this reference.

BACKGROUND OF THE INVENTION

1. The Field of the Invention

The present invention relates generally to x-ray tubes. More particularly, embodiments of the present invention relate to an x-ray tube cooling system that increases the rate of heat transfer from the x-ray tube to a cooling system medium, thereby significantly reducing heat-induced stress and strain in x-ray tube structures and extending the operating life of the device.

2. The Relevant Technology

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing.

While used in a number of different applications, the basic operation of x-ray devices is similar. In general, x-rays, or x-ray radiation, are produced when electrons are produced and released, accelerated, and then stopped abruptly. The typical basic x-ray tube has a cathode cylinder with an electron generator, or cathode, at one end. Electrical power applied to a filament portion of the cathode generates electrons by thermionic emission. A target anode is axially spaced apart from the cathode, and is oriented so as to receive electrons emitted by the cathode. Also present is a voltage source that is used to apply a high voltage potential between the cathode and the anode.

In operation, the high voltage potential is applied between the cathode and the anode, which causes the thermionically emitted electrons to accelerate away from the cathode and towards the anode in an electron stream The accelerating electrons then strike the target anode surface (or focal track) at a high velocity. The target surface on the anode is composed of a material having a high atomic number, and a portion of the kinetic energy of the striking electron stream is thereby converted to electromagnetic waves of very high frequency, i.e., x-rays. The resulting x-rays emanate from the target surface, and are then collimated through a window formed in the x-ray device for penetration into an object, such as a patient's body. As is well known, the x-rays that pass through the object can be detected and analyzed so as to be used in any one of a number of applications, such as x-ray medical diagnostic examination or material analysis procedures.

A percentage of the electrons that strike the anode target surface do not generate x-rays, and instead simply rebound from the surface. These are often referred to as "backscatter" electrons. In some x-ray tubes, some of these rebounding electrons—still traveling at relatively high velocities—are blocked and collected by a shield structure that is positioned between the cathode and the anode so the rebounding electrons do not re-strike the target surface of the anode. In this way, the rebounding electrons are prevented from reimpacting the target anode and producing "off-focus" x-rays, which can negatively affect the quality of the x-ray image. Some of the rebounding electrons may also impact the interior of the cathode cylinder.

While such a shield structure may prevent rebounding electrons from re-striking the anode target, its use can result in additional problems that can ultimately damage the x-ray tube device, and shorten its operational life. In particular, the high kinetic energy of the rebounding electrons is converted to thermal energy by the impact of those electrons on the shield structure or on the interior of the cathode cylinder. Due to the high level of kinetic energy of the electrons, the thermal energy produced by these impacts is significant and typically results in very high temperatures in the x-ray tube structures. These thigh temperatures, in combination with the high temperatures also being generated at the target anode, cause thermal stresses in the structures (including the cathode cylinder and the shield) and structure joints that can, especially over time, lead to various structural failures in the x-ray tube assembly. Moreover, because the rebounding electrons impact some portions of the cathode cylinder and shield structure with relatively greater frequency than other portions the heat produced by the rebounding electrons is not evenly distributed. Accordingly, the different heat regions are collectively characterized by varying rates of thermal expansion, resulting in mechanical stresses that can also damage the x-ray tube device, especially over numerous operating cycles.

For instance, mechanical stress and strain is induced when the cooler part of the structure resists the expansion of the hotter portion of the structure. The level of stress and strain is relatively insignificant at low temperature differentials. However, non-uniform expansion produced by high temperature differentials induces destructive mechanical stresses and strains that can ultimately cause a mechanical failure in the part. Moreover, these stresses are especially damaging to joints between attached components.

Because such high temperatures can cause destructive thermal stresses and strains in the shield structure, the cathode cylinder, and in other parts of the x-ray device, attempts have been made to minimize thermal stress and strain through the use of various types of cooling systems. However, previously available x-ray tube cooling systems have not been entirely satisfactory in providing effective and efficient cooling—especially in the regions of the shield structure and cathode cylinder.

In order to dissipate the high heat present, x-ray tubes have typically utilized some type of liquid cooling arrangement. In such systems, at least some of the external surfaces of the cathode cylinder are placed in direct contact with a circulating coolant, which facilitates a convective cooling process. Often however, this approach is not satisfactory for cooling an adjacent shield structure, which has a limited external surface area, and, because it is exposed to extremely high temperatures from rebounding electrons, is unable to efficiently transfer significant amounts of heat by convection to the coolant.

To address this problem, shield structures have been fashioned with internal cooling passages through which a coolant stream is circulated. Thus, the shield structure gives up heat primarily by convection to the coolant which flows through its interior. This approach has not been entirely satisfactory either. Due to the limited size of such cooling passages, only a limited amount of heat can be absorbed by the coolant, and consequently the shield structure may not be adequately cooled. Thus, x-ray devices of this sort may experience greater failure rates and shorter operating lives due to repeated exposure to higher temperatures and resultant stresses.

Also, in systems of this sort, the coolant must be capable of absorbing significant amounts of heat in order to preclude harmful thermal stresses and strain in the shield structure and cathode cylinder. However, with current designs, the circulated coolant eventually, and often prematurely, experiences thermal breakdown and is no longer able to effectively remove heat from the x-ray tube. Again, this translates into an x-ray device that is more subject to failure and that typically has an overall shorter operating life.

Currently available cooling system designs are lacking in another respect as well. As noted, heat produced within the x-ray tube is not evenly distributed. However, currently available cooling systems are not capable of removing heat from certain higher-temperature areas of the x-ray tube faster than cooler areas. Instead, the rate of heat transfer is fairly constant throughout the x-ray tube in existing systems. As such, those regions that are exposed to higher temperatures are not adequately cooled, and experience a greater failure rate.

There are additional problems in existing x-ray tube designs caused by excessive operating temperatures. In particular, the high operating temperatures are especially destructive to the connection points between the various component parts of the x-ray tube device. For instance, the cathode cylinder is fashioned as a single integral part that must be attached to the shield structure. The shield structure is then affixed to the housing, or "can," that encloses the x-ray tube assembly. Typically, these attachments are accomplished by way of a weld or braze joint. However, in prior art systems, these joints have been implemented in a manner that is especially vulnerable to the thermal and mechanical stresses present, and often fail prematurely. Thus, efficient removal of heat, as well as robust joint attachments between component parts is critical to maintaining structural integrity and increased operating life of the x-ray device.

Thus, there is a need in the art for a cooling system that can be used to efficiently and effectively remove heat from the x-ray tube, and especially in the areas of the cathode cylinder and the adjacent shield structure. Moreover, it would be desirable to have a system that provides sufficient heat removal to reduce the level of thermal and mechanical stresses otherwise present within the cathode cylinder and shield, and that would thereby increase the overall operating life of the x-ray tube and x-ray device. Likewise, the system should prevent heat-related damage from occurring in the materials used to fabricate the cathode cylinder and shield assembly, and should reduce structural damage from occurring between joints and/or attachment points between the various structural components. Joints between components should be more robust, and able to withstand high temperatures. Also, it would be desirable if the system could effectively remove heat at a higher rate from those areas of the system that experience higher temperatures than other portions, and thereby reduce the occurrence of varying thermal regions.

BRIEF SUMMARY AND OBJECTS OF THE INVENTION

It is therefore a general objective of the present invention to provide an improved x-ray tube cooling system that addresses the aforementioned problems in the prior art systems.

More particularly, it is a primary object of the present invention to provide an improved x-ray tube cooling system that enhances the convective and conductive heat transfer from components of the x-ray tube to a cooling system coolant, and that is especially efficient in removing heat generated as a result of back scattered electrons within the x-ray tube.

A related objective of the present invention is to provide a cooling system that reduces temperature levels present within x-ray tube components and the coolant, thereby reducing the incidence of failure within the x-ray tube due to thermal stresses and increasing the overall operating life of the x-ray tube.

Another objective of the present invention to provide an improved x-ray tube cooling system in which coolant is circulated through passages formed within a shield structure so as to more efficiently remove heat by convection from the shield structure.

Yet another object of the present invention to provide an improved x-ray tube cooling system which utilizes a shield structure that has increased internal and external surface areas in contact with the cooling system coolant, thereby improving the efficiency and rate at which heat is removed from the shield structure.

Still another objective of the present invention is to provide a cooling system in which areas of the shield structure that have a higher thermal content are cooled at a rate higher than those portions of the shield structure having a lower thermal content.

Another objective of the present invention is to provide improved brazed joints between structures of the x-ray tube that are better able to withstand the thermal and mechanical stresses present within an operating x-ray tube.

Other objects and advantages of the invention will become apparent upon reading the following detailed description and appended claims, and upon reference to the accompanying drawings.

Briefly summarized, the foregoing objects and advantages are provided with an improved x-ray tube cooling system A preferred embodiment of the system includes a reservoir containing a liquid coolant that is continuously circulated by way of a heat exchanger device. Disposed within the coolant reservoir is an x-ray tube, which consists of a cathode cylinder having an electron source, such as a cathode head assembly, disposed therein. The x-ray tube is also comprised of an evacuated housing that encloses an anode having a target surface capable of receiving electrons emitted by the electron source. Disposed between the cathode cylinder and the x-ray tube housing is a shield structure. The shield structure defines an aperture through which electrons are passed from the electron source to the target surface to generate x-rays. Moreover, the shield structure provides an electron collection surface, that prevents electrons that rebound from the target surface from re-striking the target.

In a preferred embodiment, at least one fluid passageway is formed within the shield structure. The fluid passageway receives coolant from the reservoir from an inlet port, which then passes through the passageway so as to absorb heat generated in the shield structure, including heat generated as a result of rebounding electrons striking inner surfaces of the shield.

Preferred embodiments of the cooling system also include a plurality of extended surfaces, or cooling fins, that are affixed to the outer surface of the shield structure. Coolant exiting the fluid passageway is allowed to flow across the extended surfaces, which are oriented in a manner so as to conduct heat from the shield to the coolant.

In one preferred embodiment, the cooling system also includes means for augmenting the heat transfer capability of the fluid passageway. In an illustrated embodiment, this means is comprised of a plurality of microgrooves formed inside the fluid passageway cooperatively defined by the shield structure and the aperture disk. The microgrooves serve to increase the surface area of the fluid passageway through which the coolant flows and thereby effect a relative increase in the rate of heat transfer from the shield structure to the coolant. Additionally, the microgrooves also improve the efficiency of multiphase heat transfer, beyond the improvement attributable simply to the increase in surface area, by enhancing the mechanism by which ebullition heat transfer, i.e., nucleate boiling occurs.

In an alternative embodiment, the aforementioned means for augmenting the heat transfer capability of the fluid passageway comprises a coiled spring that is disposed within the fluid passageway. The spring provides an extended surface that increases the efficiency and rate at which heat is removed from the shield structure by the coolant.

In yet another preferred embodiment, the fluid passageways that are formed within the shield structure are oriented in a manner that permits coolant to flow through a first and a second section of the shield structure. Moreover, the passageways are further oriented such that the heat is transferred away from the first section at a greater rate than in the second section. In this way, those sections (i.e., the first section) having a higher thermal content are cooled at a faster rate than those sections (i.e., the second section) having a lower thermal content. This ensures a more efficient and evenly distributed dissipation of heat, and also helps ensure that the coolant is not overly thermally stressed.

Embodiments of the invention also are disclosed that provide a more structurally sound x-ray tube assembly, and one that is thus better able to withstand the thermal and mechanical stresses present in an operating tube. For instance, an improved braze joint is provided between the shield structure and the x-ray tube housing. In particular, a braze material is placed along a joint formed along both a horizontal and a vertical surface of the shield structure and the x-ray tube housing. This ensures a connection joint that is more structurally sound, and that is able to survive the varying temperatures, and resultant stresses imposed during operation of the x-ray tube.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

DETAILED DESCRIPTION OF EMBODIMENTS OF THE INVENTION

Reference will now be made to the figures, wherein like structures will be provided with like reference designations. It is to be understood that the drawings are diagrammatic and schematic representations of presently preferred embodiments of the present invention and are not limiting of the present invention, nor are they necessarily drawn to scale.

Figure 1:
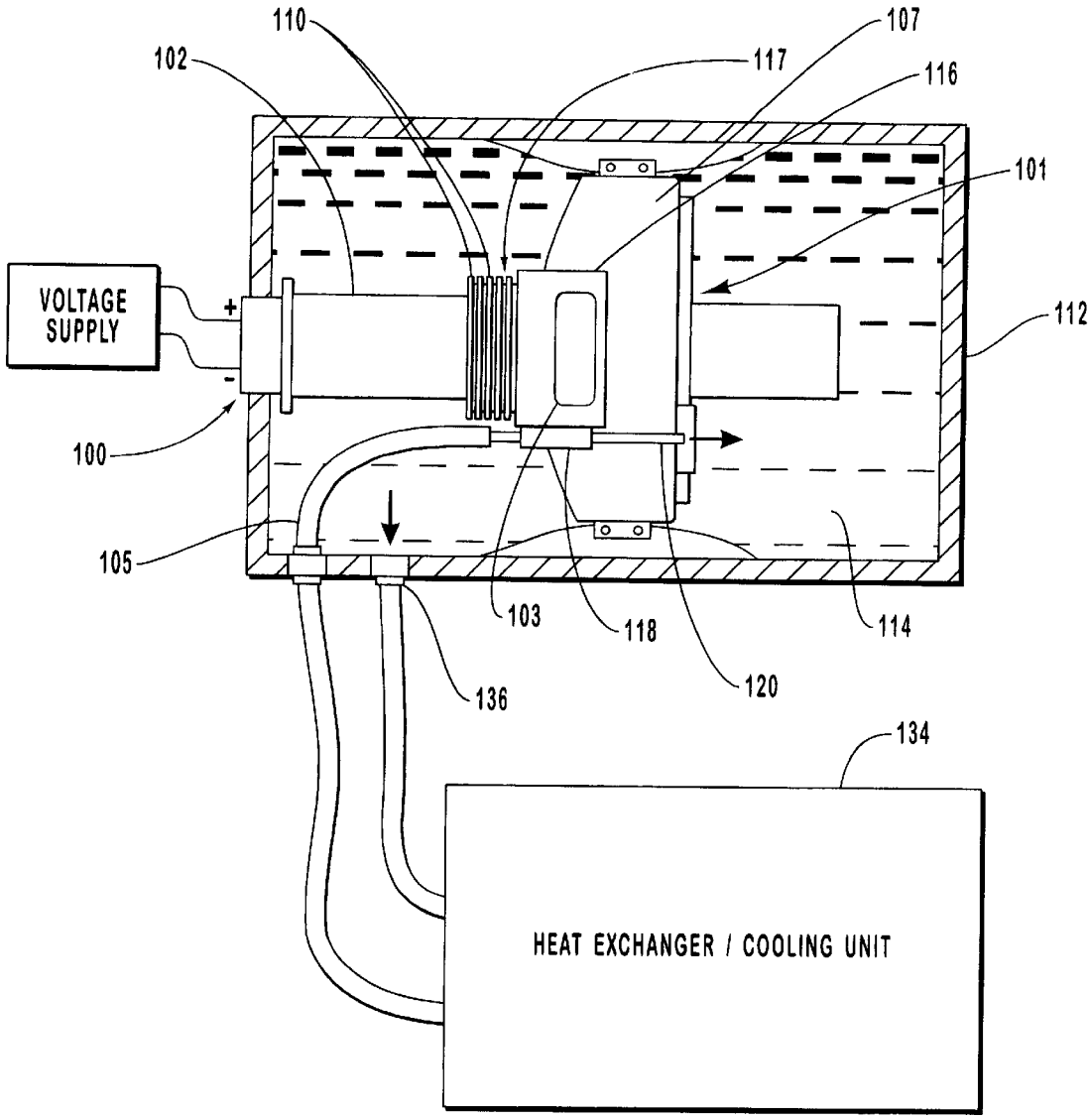
FIG. 1 is a plan view of one preferred embodiment of the cooling system.
Figure 2:
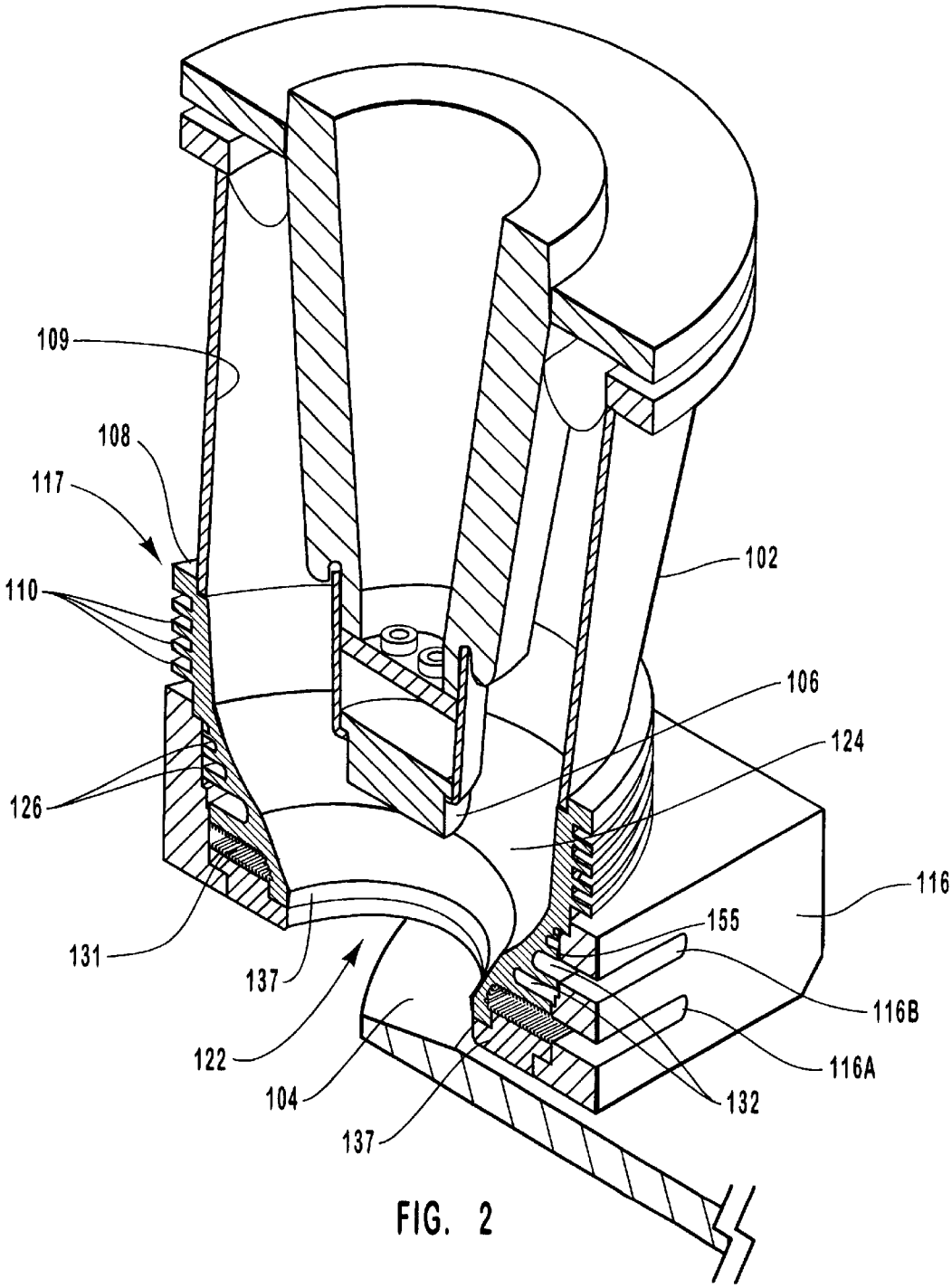
FIG. 2 is an isometric cross-section view of an embodiment of the cathode cylinder and shield structure depicted in FIG. 1.

Referring first to FIGS. 1 and 2 together, the relevant portions of an x-ray tube device are depicted generally at 100. An x-ray tube, designated generally at 101, is formed generally with an evacuated envelope housing that is typically referred to as a "can" 107. The evacuated envelope, or can, 107 is disposed within a housing 112. Disposed within can 107 is an electron source in the form of a cathode head 106, filament (not shown) and associated electronics (not shown), that is disposed within a cathode cylinder 102. Adjacent to the cathode 106, and attached to the end of cathode cylinder 102, is a electron collection device, sometimes referred to as an "aperture," and referred to herein as a shield assembly 117 which comprises a shield structure 108, and aperture disk 137 (discussed in further detail below). Also disposed within the x-ray tube 101 is a rotating target anode 104, which is axially disposed opposite to the cathode head 106. A voltage source is connected to rotating target anode 104 and cathode head 106, and electrons emitted by the cathode 106 are accelerated when a voltage difference is applied between the cathode and anode. As the high velocity electrons stream towards the anode, they pass through an aperture 122 formed within the shield structure 108. When the electrons impact the surface of the target anode 104, a portion of their kinetic energy stimulates emission of x-rays. These x-rays are then partially collimated and emitted through a window 103 (FIG. 1) for med in the side of the x-ray tube 101, and a corresponding window in the housing 112 (not shown).

As previously noted and as will be discussed in further detail below, some of the electrons that strike the surface of rotating target anode 104 do not stimulate emission of x-rays. rays. Instead, they may rebound from rotating target anode 104. As will be discussed further below, the shield structure 108 performs a number of valuable functions, including preventing the rebounding electrons from descending and re-striking rotating target anode 104—and thereby generating off-focus x-rays. In addition, some of the rebounding electrons will strike the inner surface of the cathode cylinder 102. While these rebounding electrons are thus prevented from re-striking rotating target anode 104, they are still traveling at relatively high velocities and thus still generate large amounts of heat within the shield structure 108 and the cathode cylinder 102 when they strike those structures. Consequently, this heat, in addition to the heat generated at rotating target anode 104, must be continuously removed away from the x-ray tube 101, or damage to the device may occur. As noted, excessive heat in the shield structure and the cathode housing can be problematic, particularly if shield structure and/or cathode housing are exposed to excessive heat over a relatively long period of time.

FIG. 1 illustrates how in one presently preferred embodiment, the x-ray tube 101 is completely immersed within a liquid coolant 114 that is disposed within the reservoir formed by the housing 112. As contemplated herein, "liquid coolant" includes, but is not limited to, coolants substantially comprising a liquid, as well as coolants comprising both vapor and liquid components.

During operation of the x-ray device, the coolant is re-circulated through the housing 112 via a heat exchanger/cooling unit 134. As the coolant is circulated through the housing 112, heat is dissipated from the x-ray tube components and absorbed by the coolant. Heated coolant is then circulated to the heat exchanger/cooling unit 134, where heat is removed by any appropriate means, such as a radiative surface or the like. The cooled liquid is then re-circulated back to the housing reservoir.

Generally, the rate of heat transfer is in part a function of the size of the surface area across which the heat is transferred. Thus, as noted above, the efficiency at which heat is conducted from the x-ray tube to the coolant is based partly upon the surface area of the component being cooled, which in the past has been limited—especially in the problematic areas of the shield structure and the cathode cylinder 102. Embodiments of the present invention address this problem by way of the shield structure 108, a preferred embodiment of which is shown generally in FIG. 1, and in further detail in FIGS. 2, 3, 4 and 5A. As is shown best in FIGS. 1, 2 and 15, the shield structure 108 interconnects the main body portion of can 107 of the x-ray tube 101 with the cathode cylinder 102. In the illustrated embodiment, the shield structure 108 includes a separate bottom cover, referred to as the aperture disk 137 (see FIGS. 2, 5A and 15), that is affixed to the bottom of the shield structure 108. The aperture disk 137 is in turn affixed to a corresponding recess 155 formed within the can 107. Preferably, the attachment is accomplished with a braze joint, which is described in further detail below. In a presently preferred embodiment, the shield structure 108 and the aperture disk 137 are each constructed of a aluminum oxide dispersion strengthened copper alloy, such as the material known by the tradename Glidcop AL-15 UNS C-15715 and sold by OMG Americas Inc. Other materials could also be used, including but not limited to Glidcop AL-25, and Glidcop AL-60 UNS C-15725 and UNS C-15760 respectively.

Figure 3:
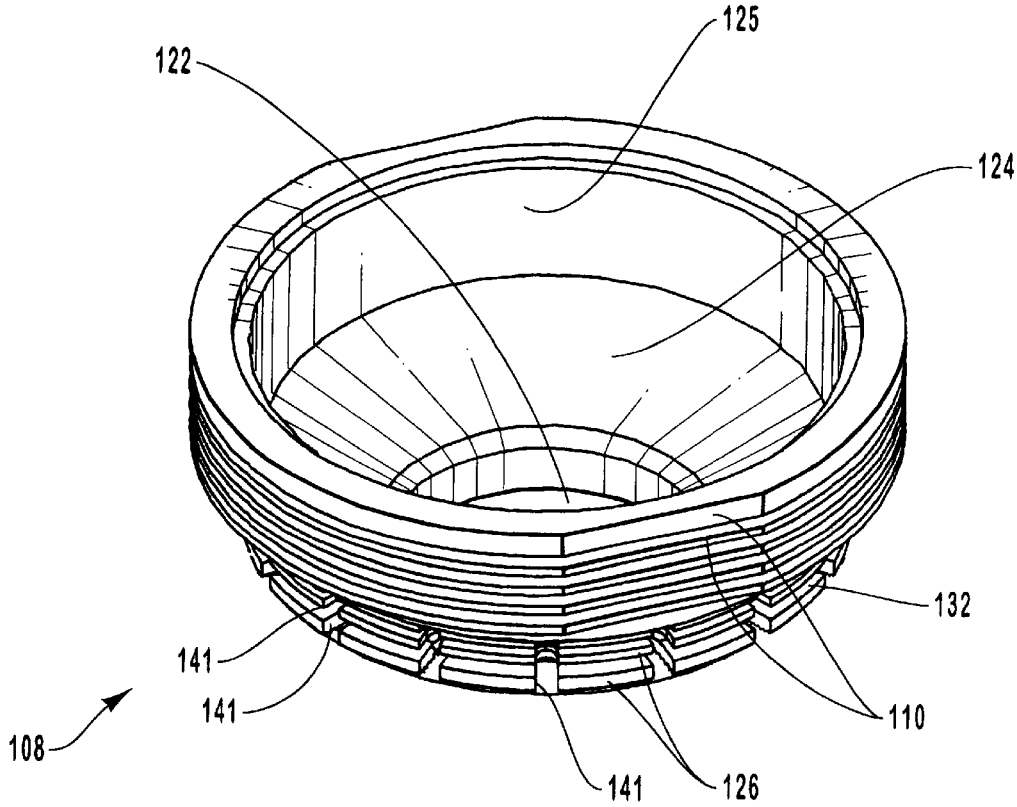
FIG. 3 is a perspective view of an embodiment of the shield structure.

As is best seen in FIGS. 2 and 3, aperture 122 of shield structure 108 and aperture disk 137 allows the electron stream to pass from the cathode head 106 to rotating target anode 104 (FIG. 2). Also, disposed about the aperture 122 is an electron collection surface 124, which provides the function of preventing rebounding electrons from descending and re-striking rotating target anode 104. The electron collection surface 124 is shaped and oriented in a manner such that the trajectory of rebounding electrons will cause them to strike the electron collection surface 124 instead of returning to the surface of rotating target anode 104. In the illustrated embodiment, the electron collection surface 124 is sloped towards the aperture 122 with a concave shape. It will be appreciated that other shapes and contours could be used.

In a presently preferred embodiment, the shield structure includes a means for transferring heat away from the shield structure. By way of example and not limitation, in one preferred embodiment the heat transfer means is comprised of a plurality of cooling members or "fins," which are designated at 110 in FIG. 1 and are shown in further detail in FIGS. 2, 3, 4 and 5A. These cooling fins 110 are comprised of adjacent annular extended surfaces formed about the periphery of the outer surface of the shield structure 108, and are at least partially exposed to the liquid coolant 114 disposed in the reservoir of housing 112, as is indicated in FIG. 1.

In general, the cooling fins 110 effectively increase the amount of surface area of the shield structure 108 that is in contact with the reservoir coolant, and they thereby function to increase the efficiency and rate at which heat is conducted and transferred from the shield to the coolant. This can best be seen in the views of an embodiment of shield structure 108 indicated in FIGS. 3 and 4. As is illustrated, the plurality of cooling fins 110 are formed about the entire outer surface of the shield structure 108, and are spaced apart so as to permit coolant to flow between the fins, and to maximize that portion of the surface area of shield assembly 117 that is exposed to the coolant. In this way, heat generated at the electron collection surface 124, the inner surface 125 of shield structure 108, or at the inner surface 109 (FIG. 2) of the cathode cylinder 102, by the impact of rebounding electrons, can be conducted to the cooling fins 110 and then more efficiently transferred to the liquid coolant 114. Thus, the cooling fins 110 are particularly useful in facilitating heat transfer by convection from the areas of the shield structure 108 and the cathode cylinder 102 to the liquid coolant 114, thereby reducing the damaging thermal effects of the rebounding electrons.

The enhanced cooling effect provided by the fins improves the operational life of the x-ray tube in other ways. By conducting relatively more of the shield structure 108 heat to the coolant, the cooling fins 110 reduce the heat load imposed on the coolant that is circulated through coolant passages formed in the shield structure (described below). In other words, the cooling fins 110 serve to more efficiently redistribute the heat conducted from the shield structure 108. In a preferred embodiment, the cooling effect produced by the fins results in a reduction of about 7 percent to about 9 percent in the heat load imposed on the circulating coolant. Because the heat load on the coolant circulating through the shield structure is reduced, the circulating coolant is substantially less likely to experience thermal breakdown. The benefit is a longer lasting and more reliable x-ray tube device.

While a preferred embodiment of this invention employs fins to increase the overall rate of heat transfer from the shield structure, and thus from the x-ray tube, it is recognized that an increase in the surface area by use of alternative structures or elements of the exposed surfaces of the shield can be used to cause a rise in the rate at which heat is transferred to the reservoir coolant. Furthermore, while cooling fins integral with the shield structure represent a preferred embodiment, this invention also contemplates discrete cooling fins, or a cooling fin structure that is separately attachable to the shield structure and/or the cathode cylinder, or similar arrangements.

The cooling system of the present invention also preferably includes additional fluid passageways that are placed substantially proximate to the sources of heat and thereby function to furthur enhance the removal of heat generated within the x-ray tube during operation—especially in the area of the shield structure 108. Examples of such fluid passageways are denoted at 131 and 132 in FIGS. 2 through 4.

Figure 4:
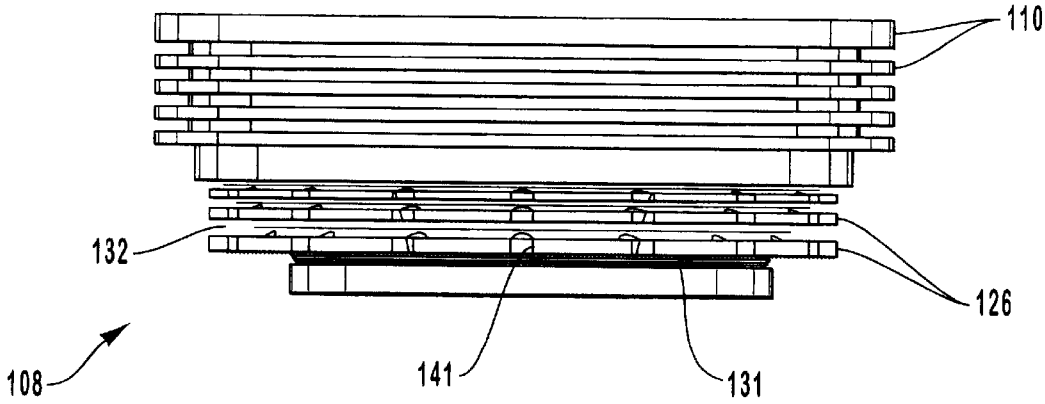
FIG. 4 is a side view of the embodiment of the shield structure of FIG. 3.

With continuing reference now to FIGS. 2 through 4, additional details are provided regarding various features of fluid passageways 132. In particular, fluid passageways 132 are formed around the outer periphery of the shield structure 108. These are formed with a plurality of spaced apart cooling surfaces 126, also in the form of ridges, that, when inserted within the recess 155 of can 107/manifold 116 abut against the inner surface of the recess 155 so as to cooperatively form individual fluid passageways 132. FIG. 3 illustrates how each of the passageways 132 are in fluid communication with one another due to gaps 141 formed between adjacent cooling surfaces 126. In addition, in a preferred embodiment, the fluid passageways 131 and 132 are placed in fluid communication with one another in a manner described below. As described in further detail below, during operation of the x-ray tube, coolant is recirculated throughout fluid passageways 131 and 132 so as to remove heat by convection from the shield structure 108.

Figure 5A:
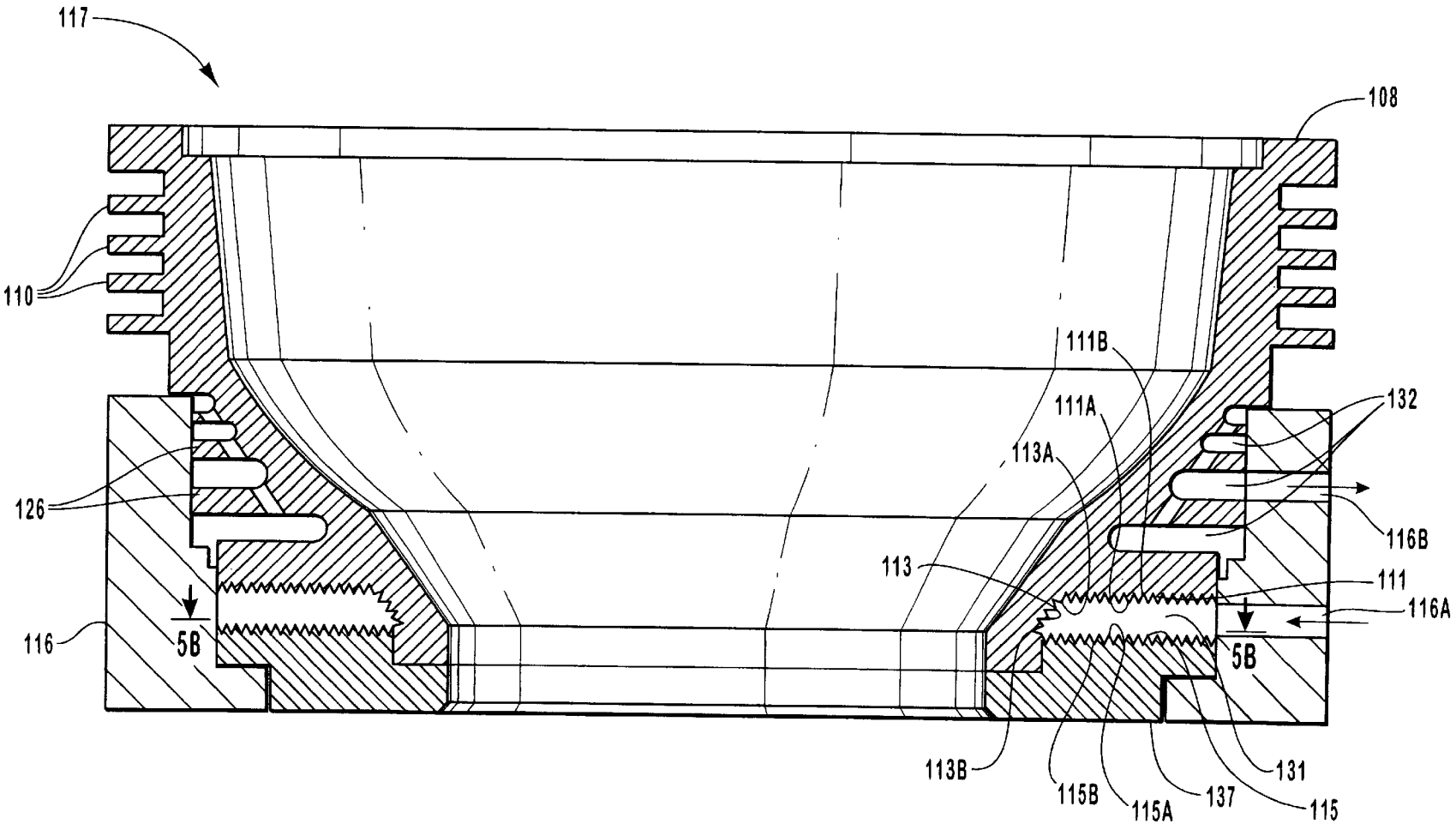
FIG. 5A is a cross-section view of an embodiment of the shield assembly.
Figure 5B:
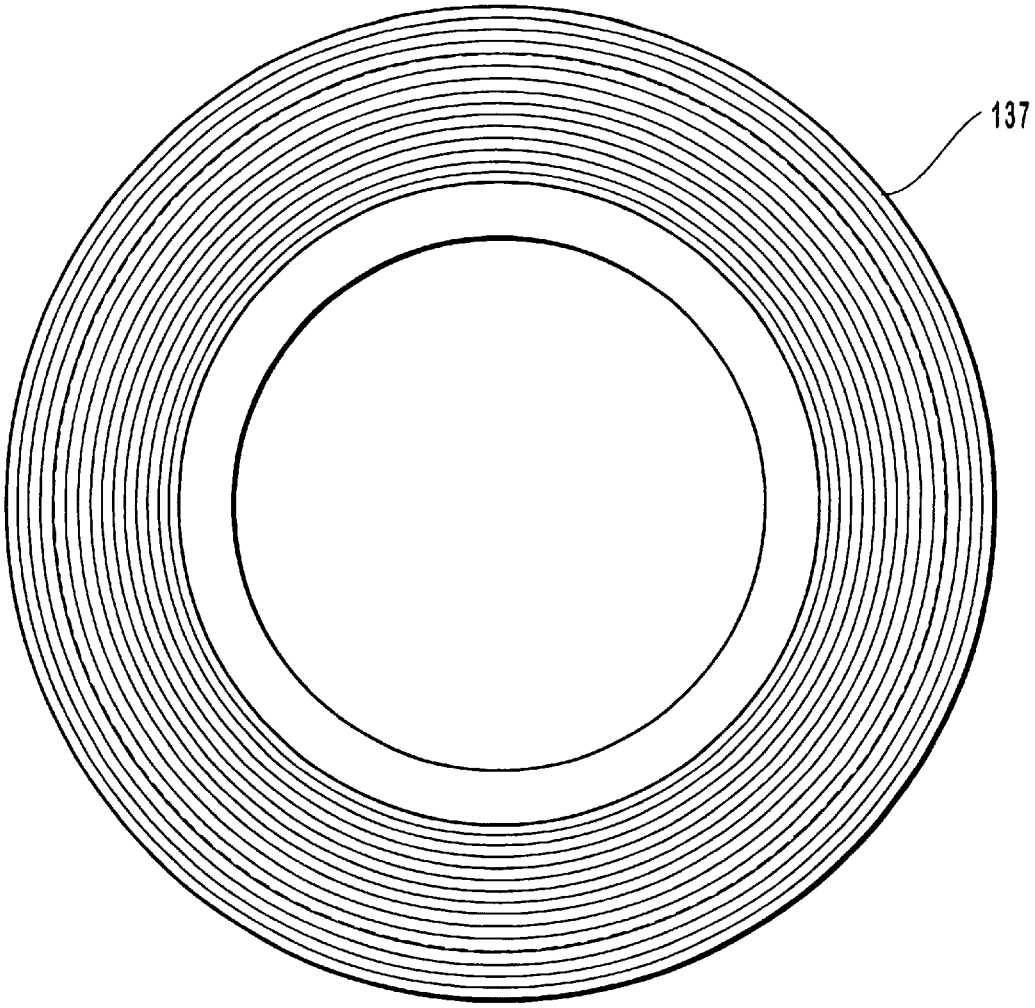
FIG. 5B is a plan view of an embodiment of an aperture disk.

With reference now to FIGS. 5A and 5B, and with continuing reference to FIG. 2, additional details are provided regarding the structure and formation of fluid passageways 131 and 132. In particular, a separate bottom cover, referred to herein as aperture disk 137, is affixed to the bottom of shield structure 108. The aperture disk 137 is then affixed, preferably via a braze joint (an embodiment of which is described below), to a recess 155 formed in can 107.

As indicated in FIGS. 5A and 5B, shield structure 108 includes surfaces 111 and 113 which cooperate with a complementary surface 115 of aperture disk 137, and with recess 155, to define fluid passageway 131 when shield structure 108 and aperture disk 137 are disposed in recess 155. One or more of surfaces 111, 113, and 115 include a plurality of extended surfaces. Preferably, the extended surfaces comprise a plurality of microridges 111A, 113A, and 115A, respectively, which are disposed upon the respective surfaces. Disposing of the extended surfaces may be accomplished by any of a number of processes, including, but not limited to, cutting, forming, attaching, defining, or otherwise providing for extended surfaces. In a preferred embodiment, each microridge has a substantially "V" shaped cross section and is formed by cutting a plurality of microgrooves (discussed below) in one or more of surfaces 111, 113, and 115.

It will be appreciated however, that a variety of other types and combinations of extended surfaces may be employed in conjunction with one or more of surfaces 111, 113, and 115. For example, the extended surfaces may be formed separately and subsequently attached to one or more of surfaces 111, 113, or 115.

Additionally, one or more of surfaces 111, 113, and 115 include a plurality of depressions as well. As contemplated herein, "depression" includes, but is not limited to, basins, concavities, dips, hollows, cavities, pockets, voids, craters, pits, grooves, channels, or the like, formed or otherwise defined in surfaces 111, 113, and 115. In a preferred embodiment, the plurality of depressions comprise a plurality of microgrooves 111B, 113B, and 115B, respectively, each having a substantially "V" shaped cross section and being collectively defined by the plurality of microridges, previously discussed.

As discussed in greater detail below, the increase in surface area realized as a consequence of the formation of the microgrooves and microridges, in combination with the roughness imparted to surfaces 111, 113, and 115 by the microgrooves, in particular, facilitates a relative increase in the rate of heat transfer from shield structure 108.

Note that FIGS. 5A and 5B simply depict one embodiment of structure which provides for an increased surface area in fluid passageway 131. In general, any surface area enhancement in, or otherwise relating to, fluid passageway 131 is contemplated as being within the scope of the present invention, whether such is effectuated by way of discrete structures, and/or by way of manipulation of the geometry of one or more of the structures defining fluid passageway 131. Some exemplary alternative geometries are discussed in detail below.

It will be appreciated that one or more of the various geometric features of some, or all, of microgrooves 111A, 113A, and 115A, and/or microridges, 111B, 113B, and 115B, or various combinations thereof, may be varied as required to achieve one or more desired effects including, but not limited to, improvement of the heat transfer capability, and the ease of manufacture, of shield structure 108. For example, microridges 111B, 113B, and 1115B may be produced in the inverted "V" shape geometry indicated in FIGS. 5A and 5B, or in a radiused point, or inverted "U" shaped, geometry. Also, while microgrooves 111A, 113A, and 115A are preferably formed so that their respective cross sections are substantially in the shape of a "V," any other cross sectional shape that serves to facilitate, maintain, or otherwise promote nucleate boiling of the coolant (discussed below) is contemplated as being within the scope of the present invention.

It will further be appreciated that, in addition to their geometry, the number and/or arrangement of microgrooves 111A, 113A, and 115A, and/or microridges, 111B, 113B, and 115B may be varied as required to achieve one or more desired effects. For example, that portion of recess 155 which forms the outer boundary of fluid passageway 131 may be confined to include a plurality of microgrooves and microridges so that the entire wetted perimeter of fluid passageway 131 comprises microgrooves and/or microridges, wherein the wetted perimeter is contemplated as comprising, collectively, those surfaces of fluid passageway 131 in contact with the liquid coolant 114. In a preferred embodiment, the wetted perimeter comprises surfaces 111, 113, 115, and that portion of recess 155 that defines the outer periphery of fluid passageway 131. Alternatively, microgrooves 111A, 113A, and 115A, and/or microridges 111B, 113B, and 115B can be selectively employed in the wetted perimeter of fluid passageway 131 so that some portions of the wetted perimeter include microgrooves and microridges, and other portions do not.

Finally, the formation of the microgrooves and microridges on at least some portions of the wetted perimeter of fluid passageway 131 may be such that they are arranged substantially parallel to each other and to the flow of liquid coolant 114 through shield structure 108 and aperture disk 137. Exemplary arrangements include, but are not limited to, those wherein the microgrooves and microridges are disposed in a concentric or phonographic arrangement. It will be appreciated that such arrangements serve to facilitate a relative increase in heat transfer from shield structure 108 to liquid coolant 114, without materially impairing the pressure or flow rate of liquid coolant 114 passing through shield structure 108 and aperture disk 137.

As suggested above, microgrooves 111A, 113A, and 115A, and microridges 111B, 113B, and 115B have a variety of characteristics which serve to facilitate a relative increase in the rate of heat transfer from shield structure 108, and thus an improvement in the service life and performance of x-ray tube 101.

One such characteristic relates to the surface area of microgrooves 111A, 113A, and 115A, and microridges 111B, 113B, and 115B. In particular, because microgrooves 111A, 113A, and 115A, and microridges 111B, 113B, and 115B serve to, among other things, provide a relative increase in the overall surface area of shield structure 108 that is in contact with the liquid coolant 114 flowing through fluid passageway 131, the overall rate of heat transfer from shield structure 108 to liquid coolant 114 is correspondingly increased. This effect is explained at least in part by the well-known relationship, discussed elsewhere herein, between the size of a particular surface area and the rate of heat transfer across that is particular surface. By thus providing a vehicle for facilitating a relative increase in the rate of heat transfer from shield structure 108 to liquid coolant 114, microgrooves 111A, 113A, and 115A, and microridges 111B, 113B, and 115B cooperate to materially reduce the likelihood of the incidence of thermally-induced stresses and strains that are potentially destructive to the various structures of x-ray tube 101.

As discussed above, the increased surface area provided by the microgrooves 111A, 113A, and 115A, and microridges 111B, 113B, and 115B serves to effectuate an improvement in the heat transfer capability of the shield structure 108. However, the desirable effects implicated by the microridges, and microgrooves in particular, are not limited solely to those relating to the increase in shield structure 108 surface area. In fact, other desirable effects implicated by the microgrooves relate to various specific features of their geometry.

In particular, the roughness of the wetted perimeter of fluid passageway, achieved through the use of microgrooves and microridges, serves to stimulate and/or enhance nucleate boiling of the coolant flowing through the fluid passageway. Typically, nucleate boiling results in a dual phase flow of coolant, that is, the coolant is present in both liquid and vapor states. It is well known that nucleate boiling is a highly efficient vehicle for the transfer of heat and that, to a large extent, the heat flux achieved with nucleate boiling increases in correspondence with the surface roughness. In general then, a relatively rougher surface facilitates a relative increase in heat transfer over what could be achieved through employment of a relatively smooth surface that is equivalent to the rougher surface in all other respects.

Surface roughness may be considered in terms of the availability of nucleation sites, or those geometric features which, by virtue of their shape and/or disposition, help to promote and maintain nucleate boiling. In particular, the vertices of the "V" shaped microgrooves act as nucleation sites inside fluid passageway 131. Accordingly, the microgrooves are particularly well-suited to facilitate stimulation and maintenance of nucleate boiling.

Note that a variety of means may be profitably be employed to perform the functions, enumerated herein, of the plurality of depressions. Microgrooves 111B, 113B, and 115B are but one example of a means for facilitating nucleate boiling of the coolant. Accordingly, the microgrooves disclosed herein simply represent one embodiment of structure capable of performing this function. It should be understood that this structure is presented solely by way of example and should not be construed as limiting the scope of the present invention in any way.

To briefly summarize, microgrooves 111A, 113A, and 115A, and microridges 111B, 113B, and 115B facilitate a relative improvement in heat transfer from shield structure to liquid coolant 114 in at least two ways. First, microgrooves 111A, 113A, and 115A, and microridges 111B, 113B, and 115B embody an increase in the overall surface area of shield structure 108 in contact with liquid coolant 114. Because the rate of heat transfer is at least partly a function of surface area, the increased surface area of shield structure 108 permits a relative increase in the rate of heat transfer from shield structure 108 to liquid coolant 114. Additionally, the roughness imparted to the wetted perimeter of fluid passageway 131 by microridges 111B, 113B, and 115, and in particular, by microgrooves 111A, 113A, and 115A, and serves to stimulate and maintain nucleate boiling of liquid coolant 114, and thereby desirably increases the heat flux between shield structure 108 and liquid coolant 114.

Various additional features of shield assembly 117 and its operation in conjunction with other components of x-ray tube 101, with particular attention to the flow path of liquid coolant 114, are indicated in the following discussion. In general, and as indicated in FIG. 1, the liquid coolant 114 is supplied to the housing 112 via a inlet conduit 105 disposed within the housing 112 reservoir. The inlet conduit 105 is connected to a manifold inlet/outlet connection 118 that is affixed, or formed integrally with, a coolant manifold 116 that is disposed on, or formed as an integral part of, can 107 of the x-ray tube 101. The coolant manifold 116 forms a fluid communication path between the inlet conduit 105 and the fluid passageways 131 (not shown) via an inlet port hole formed in can 107/coolant manifold 116 (not shown).

In particular, fluid communication between inlet conduit 105 and fluid passageways 131 is achieved by aligning an inlet port hole 116A (see FIG. 5A) formed in can 107/coolant manifold 116 with fluid passageway 131. Inlet port hole 116A, in turn, is in fluid communication with manifold inlet/outlet connection 118, discussed elsewhere herein. As discussed in additional detail below, the coolant introduced from inlet port hole 116A flows into fluid passageway 131 whereupon each flow circulates in opposing azimuthal directions. Of course, as the liquid coolant 114 proceeds through fluid passageway 131, heat is transferred to liquid coolant 114 from the shield structure 108.

Additionally, fluid passageway 131 is placed in fluid communication with fluid passageway 132 (not shown) by way of a cavity 200 (see FIG. 6A) defined within the interior wall of recess 155. Cavity 200 is sufficiently large as to facilitate fluid communication between fluid passageway 131 and at least one of fluid passageways 132. Thus, in this embodiment, two coolant flows proceed through fluid passageway 131 and then converge at the opposite side of the shield structure 108. The coolant then continues to flow into the cavity 200 and thence into the upper half of the shield structure 108 via fluid passageways 132. Again, the coolant splits and the two flows traverse the upper half of the shield structure 108. Also, as in the lower half, the coolant is heated as it flows over the shield and the cooling surfaces 126.

With continuing reference to FIG. 1, the two flows of coolant traverse the upper half of shield structure 108, converge, and then exit fluid passageway 132 and pass through an outlet port hole 116B (see FIG. 5A) formed in can 107/coolant manifold 116 and in fluid communication with manifold inlet/outlet connection 118. Outlet fluid conduit 120 of manifold inlet/outlet connection 118 is in fluid communication with the reservoir of housing 112, as is indicated by the fluid flow line. It will be appreciated that in certain x-ray tube configurations, another manifold may be used to direct the coolant, or a portion thereof, to other cooling passages formed within other areas of the x-ray tube to effect additional heat removal by convection, before being discharged into the reservoir.

Once discharged into the reservoir of housing 112, liquid coolant 114 flows over the external surfaces of the x-ray tube, including the cooling fins 110 of the shield structure 108 as previously described, and cools by convection. Ultimately, the liquid coolant 114 exits the reservoir of housing 112 at reservoir discharge connection 136, and flows back to the heat exchanger/cooling unit 134 to repeat the cycle, as is illustrated in FIG. 1. Thus, the convective heat transfer effected by the cooling fins 110 complements the heat transfer achieved through convective cooling in the fluid passageways 131 and 132, and thus provides a relative increase in the overall rate of heat transfer from the shield structure 108.

It will be appreciated that other arrangements may be used for providing coolant to fluid passageways 131 and 132 could be utilized. For instance, although the inlet port hole 116A is connected to fluid passageway 131, and the outlet port hold 116B to fluid passageway 132, an opposite arrangement could be used. Moreover, multiple inlet ports and/or multiple outlet ports could also be utilized and, as noted, additional manifolds could be used to direct the coolant to other areas of the x-ray tube. Also, one of skill in the art will recognized that different arrangements could be utilized for placing fluid passageways 131 and 132 in fluid communication with each other.

In addition, the relative orientation of the inlet port hole 116A from coolant manifold 116 to the passageways 131 in the lower half of the shield structure 108 may be varied. For example, inlet port hole 116A is preferably positioned directly opposite to, i.e., along a 180 degree angle, the point at which the coolant enters the upper half of the shield structure 108 and passageways 132. That is, inlet port hole 116A is preferably positioned 180 degrees from cavity 200.

Figure 6B:
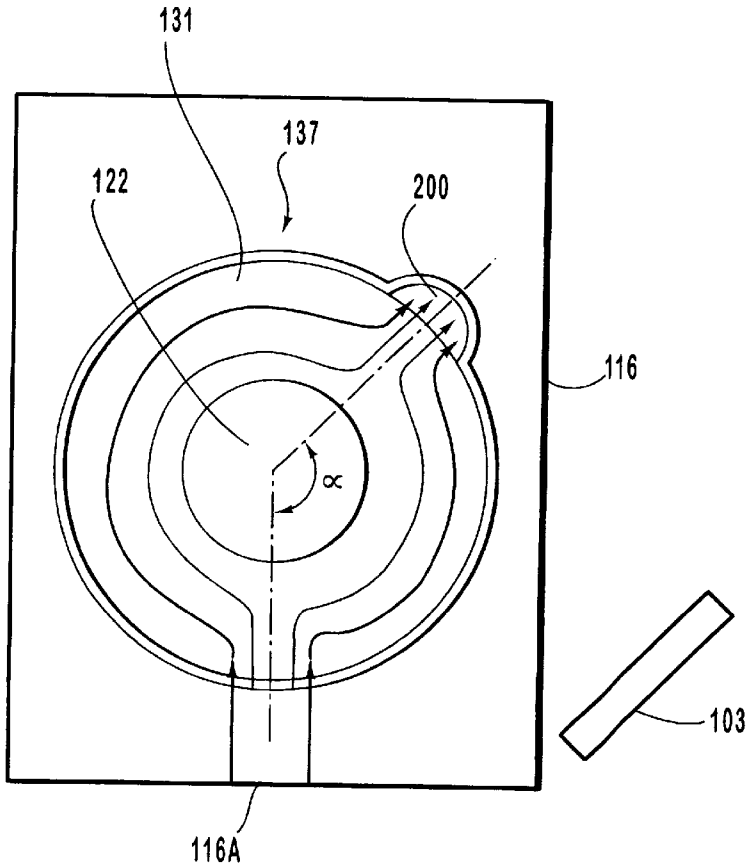
FIG. 6B is a plan view of an alternative embodiment of the aperture disk indicated in FIG. 6A.
Figure 6A:
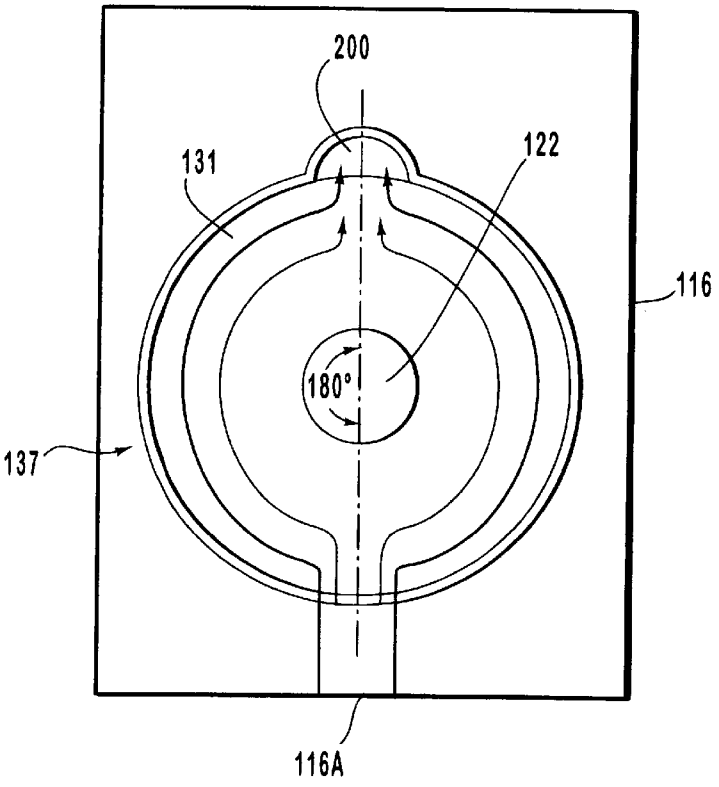
FIG. 6A is a plan view of an embodiment of an aperture disk, indicating the flow path of coolant through the lower fluid passageway of the shield assembly.

This flow scheme is schematically represented in FIG. 6A, where coolant enters the lower half of the shield structure 108 via inlet port hole 116A, then splits into two flows that each circulate in opposing azimuthal directions. The two flows then converge at the cavity 200, where it enters the upper half of the shield structure 108 via fluid passageways 132. With this type of setup, the flow rate of the two flows is approximately equal, and thus the rate of heat transfer is approximately equal.

However, as noted, the heat distribution within the shield structure 108 is non-uniform. Namely, the side of the shield that is more proximate to the window 103 is typically subjected to higher temperatures than the opposite side. This is due to the effect imposed by the target angle on the back scattered electrons, i.e., more electrons hit the window side of the electron collection surface 124 than the centerline side. As such, in another embodiment, the coolant flow rate is increased in that portion of the shield having a higher thermal content (i.e., the side more proximate to the window 103), which thereby increases the rate of heat removal.

In one embodiment, this is accomplished by varying the relative orientation of the inlet port hole 116A, and/or cavity 200, with respect to fluid passageways 131. This particular arrangement is represented in FIG. 6B. As is shown, an angle of less than 180 degrees is used to orient the inlet port hole 116A with fluid passageway 131 and the cavity 200 on the side proximate to the window 103. This decrease in relative travel distance increases the coolant flow rate, thereby increasing the convective heat transfer coefficient on that side and decreasing the shield's temperature gradient in the azimuthal direction. Consequently, the heat transfer rate on the window side is increased. Conversely, the heat transfer is decreased on the remaining side of the shield structure 108.

Increasing the rate of heat transfer can be accomplished with other approaches as well. For instance, in the side proximate to the window 103 (or whatever portion has higher thermal content), the flow area cross section of fluid passageway 131 could be increased, and the passageway disposed in the opposite/remaining portion of the shield decreased. This would increase the volume of coolant flow through the portion of the shield having a higher thermal content, and thus increase the rate of heat transferred by convection.

Figure 7:
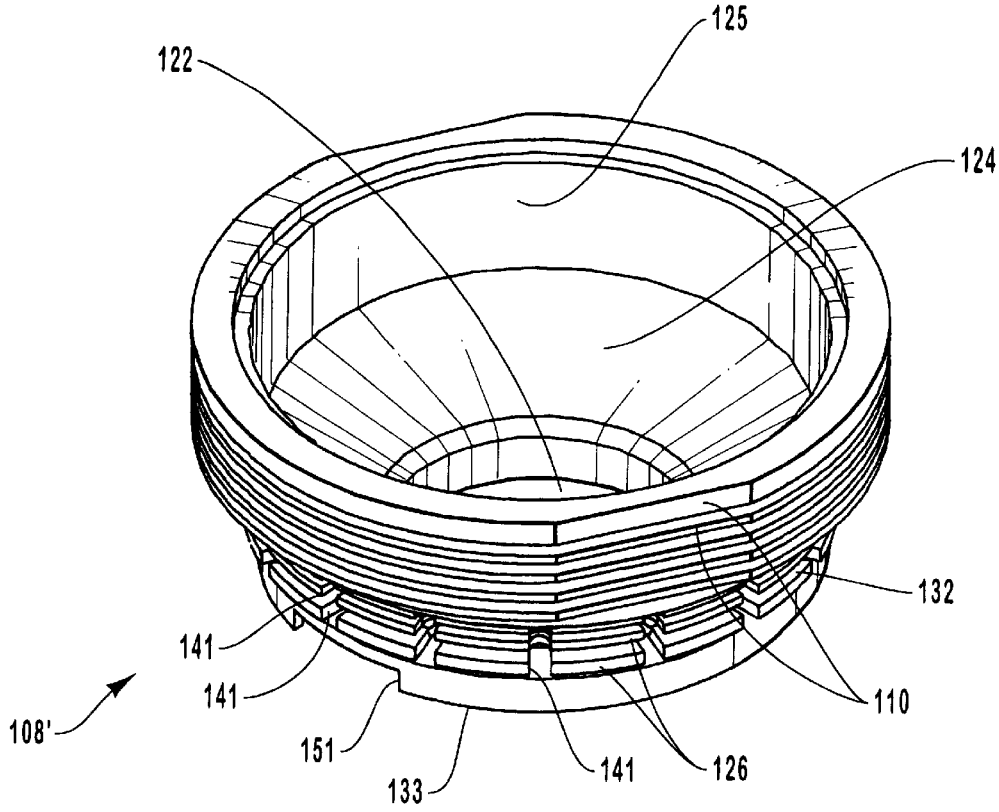
FIG. 7 is a perspective view of another embodiment of the shield assembly.
Figure 8:
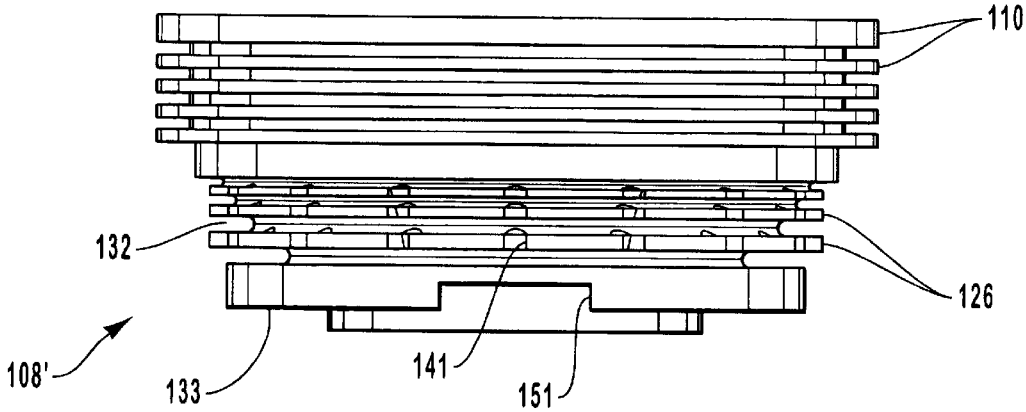
FIG. 8 is a side view of the embodiment of the shield structure of FIG. 7.

It will be appreciated that the shield assembly 117, shield structure 108, and/or aperture disk 137 may be embodied in a variety of different ways. Various features of an exemplary alternative embodiment of the shield structure are indicated in FIGS. 7 and 8, where an alternative embodiment of the shield structure is indicated at 108'. As the structure and operation of this alternative embodiment of the shield structure are similar in many regards to that of shield structure 108, no additional discussion of the common features and elements thereof is required. Any material differences between the embodiments depicted in FIGS. 3 and 4, and FIGS. 7, 8 and 11, respectively, such as gap 151, are addressed primarily in the context of the discussion of FIGS. 9, 10, 11, 12A, and 12B, below.

Figure 9:
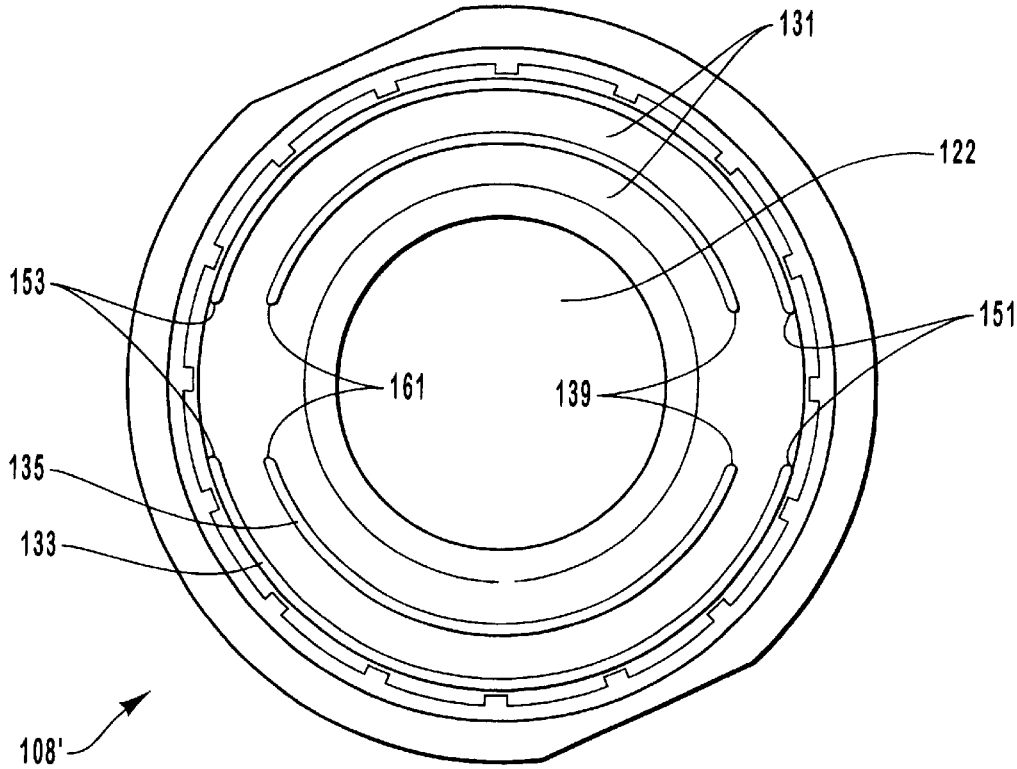
FIG. 9 is a plan view of the embodiment of the shield structure of FIG. 7.
Figure 10:
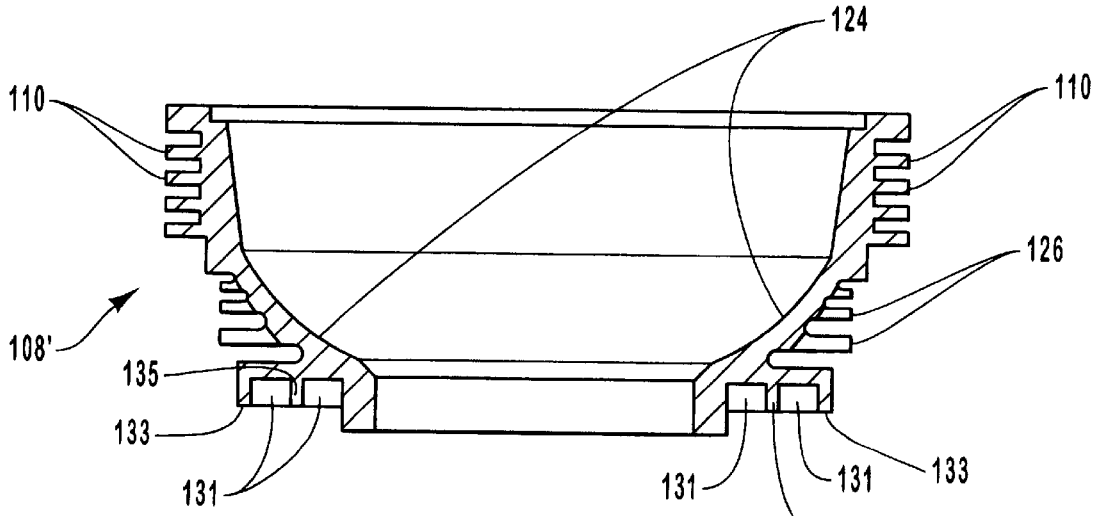
FIG. 10 is a cross-section of the embodiment of the shield structure of FIG. 7.

Directing attention now to FIGS. 9 and 10, shield structure 108' includes, among other things, a plurality of fluid passageways 131 formed in the bottom half section of the shield structure 108'. It will be appreciated that fluid passageways 131 can be formed directly and integrally within the body of the shield structure 108' (i.e., in the form of a hollow bore), or, as is the case with the illustrated embodiment, can be formed by defining channels with spaced apart ridges 133 and 135 in the bottom of the shield structure 108'.

Figure 11:
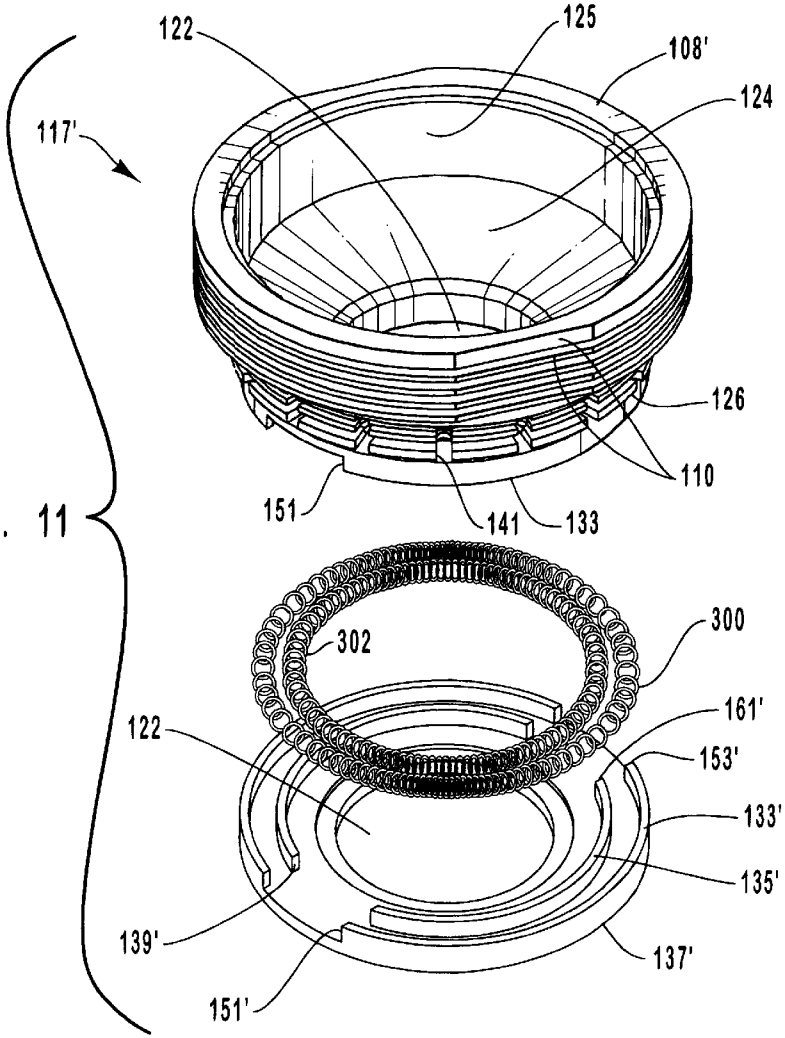
FIG. 11 is an exploded perspective view of another embodiment of the shield structure.

With reference now to FIG. 11 and with continuing reference to FIGS. 9 and 10, additional details of an alternative embodiment of the shield assembly, indicated generally at 117', are indicated. In particular, aperture disk 137' of shield assembly 117' includes a corresponding aperture 122, as well as complementary ridges, designated at 133' and 135', that abut against the ridges 133, 135 on shield structure 108' of shield assembly 117', thereby forming fluid passageways 131 when the aperture disk 137' is mated with the shield structure is 108'. In the illustrated embodiment, both fluid passageways labeled as 131 are in fluid communication with one another by virtue of gaps formed in circular ridge 135, as is illustrated in FIG. 11.

Figure 12B:
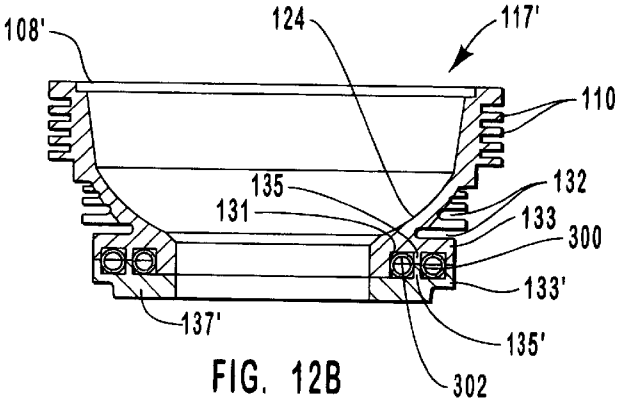
FIG. 12B is a cross-section view, taken along line 12B—12B in FIG. 12A, of the embodiment of the shield structure depicted in FIG. 11.
Figure 12A:
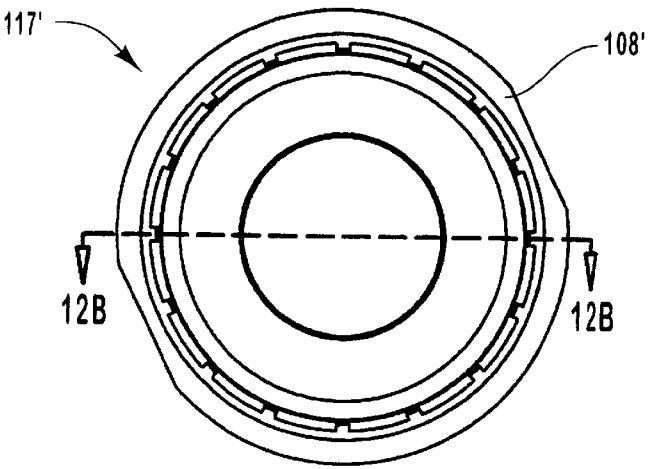
FIG. 12A is a plan view of the embodiment of the shield structure depicted in FIG. 11.

Directing attention now to FIGS. 12A and 12B, and with continuing attention to FIG. 11, shield assembly 117' may include means for augmenting the heat transfer capability of fluid passageways 131. One exemplary structure for performing this function comprises coiled wires, designated in FIGS. 11 and 12B at 300 and 302, disposed within fluid passageways 131.

The cross-sectional side view of FIG. 12B illustrates the coiled wires, or coils, 300 and 302 disposed within the fluid passageways 131, wherein fluid passageways 131 are formed when ridges 133' and 135' mate with corresponding ridges 133 and 135 formed on the bottom of shield structure 108'. Coils 300 and 302 are preferably comprised of a thermally conductive material, such as copper or an aluminum oxide dispersion strengthened copper alloy of the sort used in the shield. Each turn of the coiled wire can have either a circular or noncircular cross section and, optionally, can have non-uniform diameter/thickness. Turns of the coiled wire can be secured to the interior wall of the fluid passageway by brazing, or similar attachment means, which also can increase thermal conduction.

Each coil 300 and 302 augments the heat transfer rate provided by liquid coolant 114 within fluid passageway 131. In particular, the presence of coils 300 and 302 adds additional surface area within fluid passageway 131, which thereby facilitates a relative increase in the transfer of heat over what would otherwise be possible. In addition, coils 300 and 302 break up the boundary layers of liquid coolant 114 as it passes over coils 300 and 302 within fluid passageway 131. Disruption of the coolant boundary layer promotes turbulence in the coolant flow, and thereby improves heat transfer. Moreover, because of the gaps (shown at 139'/161' and 151'/153' in aperture disk 137' of FIG. 11) formed in fluid passageways 131, liquid coolant 114 flows both parallel and perpendicular to the axes of coils 300 and 302. This further increases the rate and efficiency at which heat is transferred away from the shield structure 108'.

It will be appreciated that other structures could be used to provide the heat transfer augmentation function performed by coils 300 and 302. Essentially any structural component that provides an extended heat transfer surface within the passageway could be used. For instance, a twisted tape, copper foil type element could be used. Also, wire orientations other than the coil arrangement illustrated could be used.

Various additional features of shield assembly 117' and its operation in conjunction with other components of x-ray tube 101, with particular attention to the flow path of liquid coolant 114, are indicated in the following discussion.

In general, and as indicated in FIG. 1, the liquid coolant 114 is supplied to the housing 112 via an inlet conduit 105 disposed within the housing 112 reservoir. The inlet conduit 105 is connected to a manifold inlet/outlet connection 118 that is affixed, or formed integrally with, a coolant manifold 116 that is disposed on, or formed as an integral part of, the can 107 of the x-ray tube 101. The coolant manifold 116 forms a fluid communication path between the inlet conduit 105 and the fluid passageways 131 (not shown) via an inlet port hole formed in the manifold (not shown).

In particular, fluid communication between inlet conduit 105 and fluid passageways 131 is achieved by orienting the shield structure 108' within the coolant manifold 116 such that a gap 151/151' (see FIG. 11) formed in abutting ridges 133/133' (see FIGS. 11 and 12B) is aligned with the inlet port hole (not shown) so as to receive incoming liquid coolant 114 from inlet conduit 105. Coolant is thus allowed to flow into passageways 131. As the coolant enters fluid passageway 131, it splits into two flows, where each flow circulates in opposing azimuthal directions, as suggested in FIGS. 13A and 13B. Of course, as the coolant proceeds through fluid passageway 131, heat is transferred to liquid coolant 114 from the shield structure 108'.

The flow of coolant through shield structure 108' is not necessarily restricted to fluid passageways 131 however. In the illustrated embodiment, fluid passageway 131 is further placed in fluid communication with fluid passageway 132. As indicated in FIG. 9, this is accomplished by providing another gap 153 in ridge 133 at a point substantially opposite gap 151, as well as providing a corresponding gap 153' in aperture disk 137' substantially opposite gap 151'.

Figure 13B:
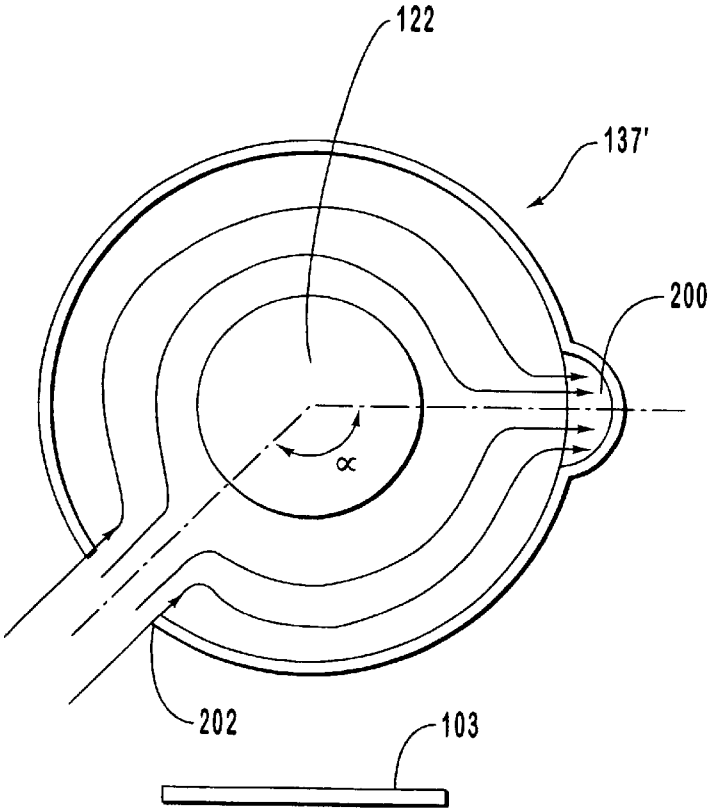
FIG. 13B is a plan view of an alternative embodiment of the aperture disk indicated in FIG. 13A.
Figure 13A:
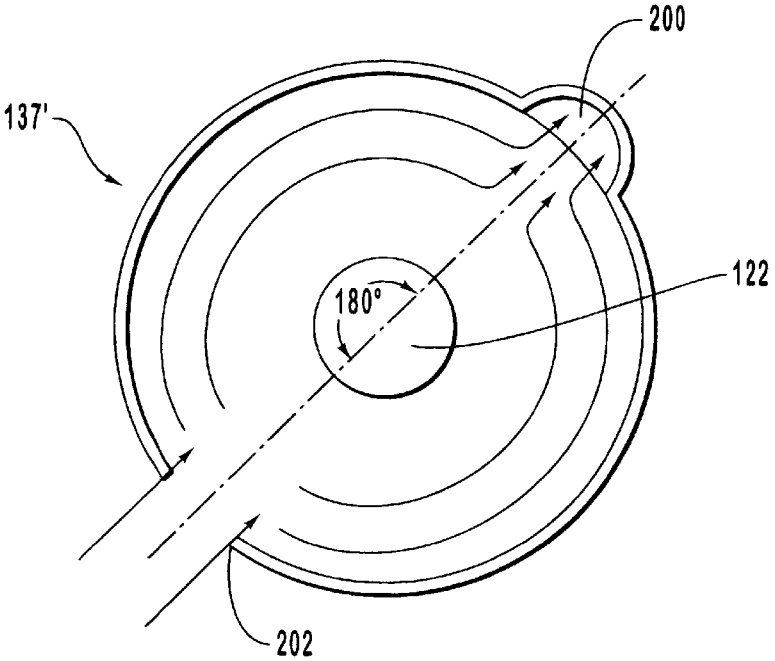
FIG. 13A is a plan view of another embodiment of the aperture disk, indicating the flow path of coolant through the lower fluid passageway of the shield assembly.

As indicated in FIGS. 13A and 13B, a cavity, designated generally at 200, is defined within the interior wall of recess 155. Cavity 200 is aligned with gap 153, and is sufficiently large as to facilitate fluid communication between fluid passageway 131 and at least one of fluid passageways 132. Thus, in this example embodiment, two coolant flows proceed through fluid passageway 131 and then converge at the opposite side of the shield structure 108'. The liquid coolant 114 then continues to flow into the cavity 200 via gap 153/153', and then into the upper half of the shield structure 108' via fluid passageways 132. Again, the coolant splits and the two flows traverse the upper half of the shield structure 108'. Also, as in the lower half, the coolant is heated as it flows over the shield structure 108' and cooling surfaces 126.

With continuing reference to FIG. 1, the two flows of coolant traverse the upper half of shield structure 108', converge, and then exit at an outlet port hole (not shown) formed in manifold inlet/outlet connection 118 and in fluid communication with fluid passageway 132. Outlet fluid conduit 120 is in fluid communication with the reservoir, as is indicated by the fluid flow line.

Figure 14:
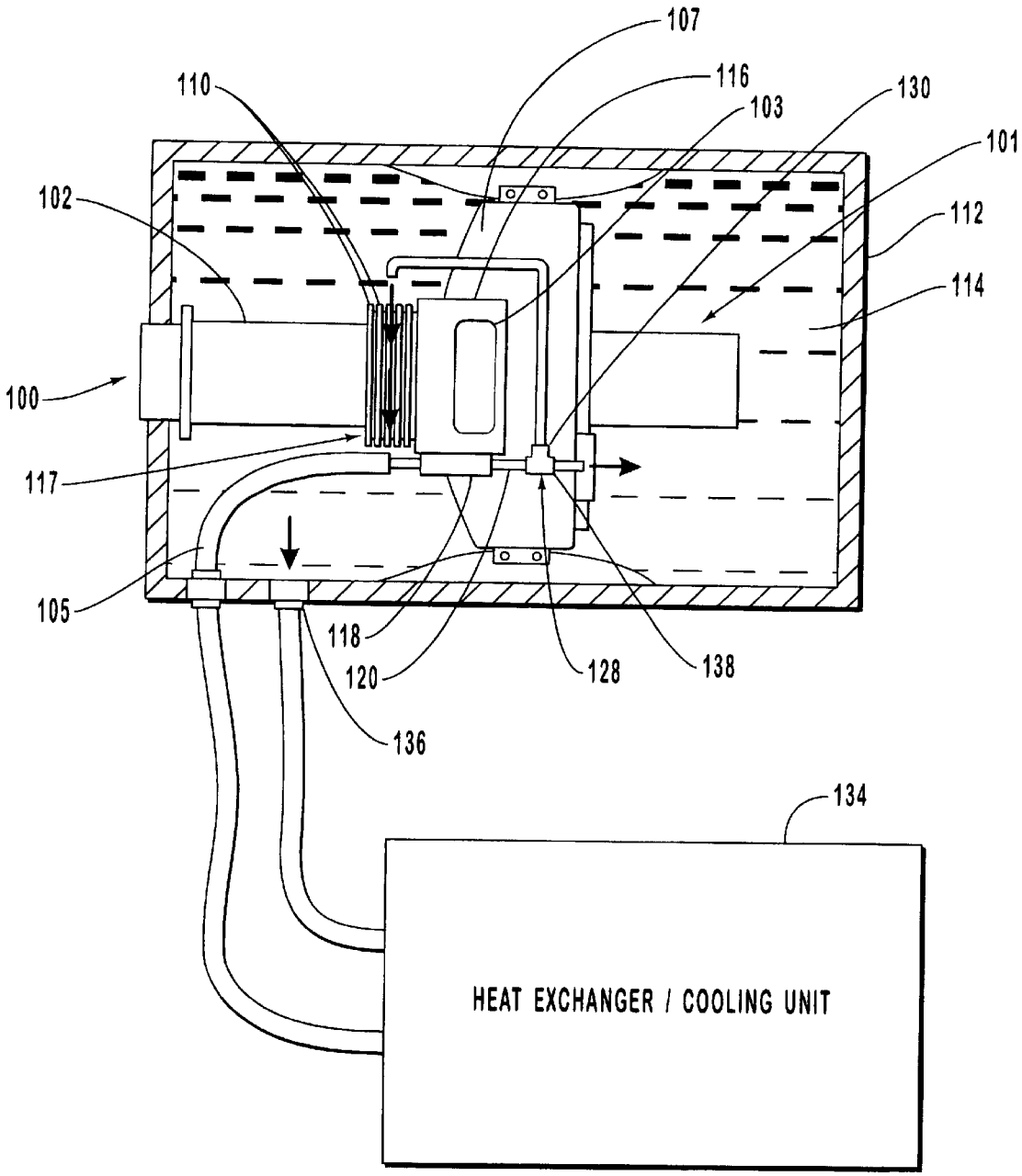
FIG. 14 is a plan view of an alternative embodiment of the cooling system.

Reference is now made to FIG. 14, which illustrates a presently preferred embodiment of a cooling system. It will be appreciated that any of the embodiments of the shield structure discussed or contemplated herein may be profitably employed in conjunction with this cooling system.

As suggested in FIG. 14, the coolant manifold 116 operates in conjunction with cooling fins 110 to facilitate an enhanced convective cooling of shield assembly 117, and thus, of the x-ray tube device 100 as a whole. Specifically, a coolant flow is generated by. a heat exchanger/cooling unit 134 as previously described, and coolant flows through inlet conduit 105, into the coolant manifold 116, and into fluid passageways 131 and 132.

However, instead of discharging the coolant directly into the reservoir as described; in FIG. 1, the outlet fluid conduit 120 is connected to a flow diverter, designated at 128, which splits the coolant into two discharge streams. One of the coolant streams from the flow diverter 128 is discharged to the reservoir 112 through coolant outlet port 138 (or, optionally, into another manifold where it can be directed to other areas of the x-ray tube, as previously noted). The other coolant stream from the flow diverter 128 is discharged through coolant outlet port 130 and the flow is specifically directed across cooling fins 110. This directed flow more efficiently removes heat from the cooling fins 110. As in FIG. 1, the coolant eventually exits the reservoir at the reservoir discharge connection 136 and flows back to the heat exchanger/cooling unit 134 to repeat the cycle.

The embodiment of the cooling system illustrated in FIG. 14 enhances cooling of the x-ray tube by: i) providing cooling fins 110 to increase the surface area of the x-ray tube, and in particular the shield structure 108, thereby increasing the rate of convective heat transfer from the x-ray tube structures to the reservoir coolant; ii) directing a portion of the manifold coolant discharge across the fins to increase convective heat transfer from the fins, thus augmenting the convective cooling effect of the fins; and iii) convectively cooling the interior of the shield structure. The combined effect of the fluid passageways, external fins, and dual discharge manifold is to significantly increase the rate at which heat is removed from the x-ray tube. The enhanced heat transfer rate serves to reduce x-ray tube operating temperatures and thus the resultant thermal mechanical stresses, and substantially prevents thermal breakdown of the coolant, thereby extending the life of the coolant and, accordingly, the x-ray tube.

It will be appreciated that while the aforementioned preferred embodiment teaches a dual outlet flow diverter, it should be recognized that a flow diverter with multiple outlets could be utilized. Accordingly, an x-ray tube cooling system employing a multiple outlet (i.e., greater than two) flow diverter is contemplated as being within the scope of the present invention.

Figure 16:
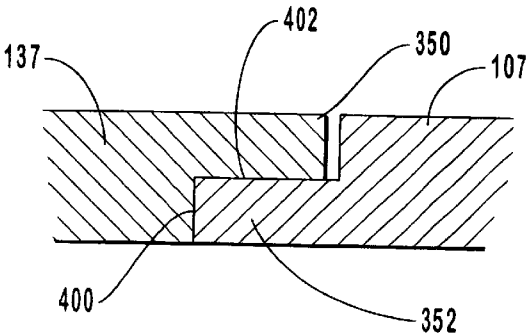
FIG. 16 is a detail view taken along line 16—16 in FIG. 15, showing an embodiment of a braze joint configuration between the aperture disk and the can.

As noted above, the excessive temperatures present in the area of the shield and aperture disk assembly cause mechanical stresses that can be especially problematic in areas where two components are attached. These areas are often the most subject to failure. As such, embodiments of the present system are directed to addressing this problem, especially where the shield structure 108 and the aperture disk 137 to the can 107. In particular, an improved braze joint configuration between the aperture disk 137 and the can 107 is provided. Instead of providing a joint that is brazed only on a horizontal surface, as is common in the prior art, the aperture disk is brazed to the can on both a horizontal as well as a vertical surface. Preferred embodiments of this brazing arrangement are shown in FIGS. 15 and 16, to which reference is now made.

Figure 15:
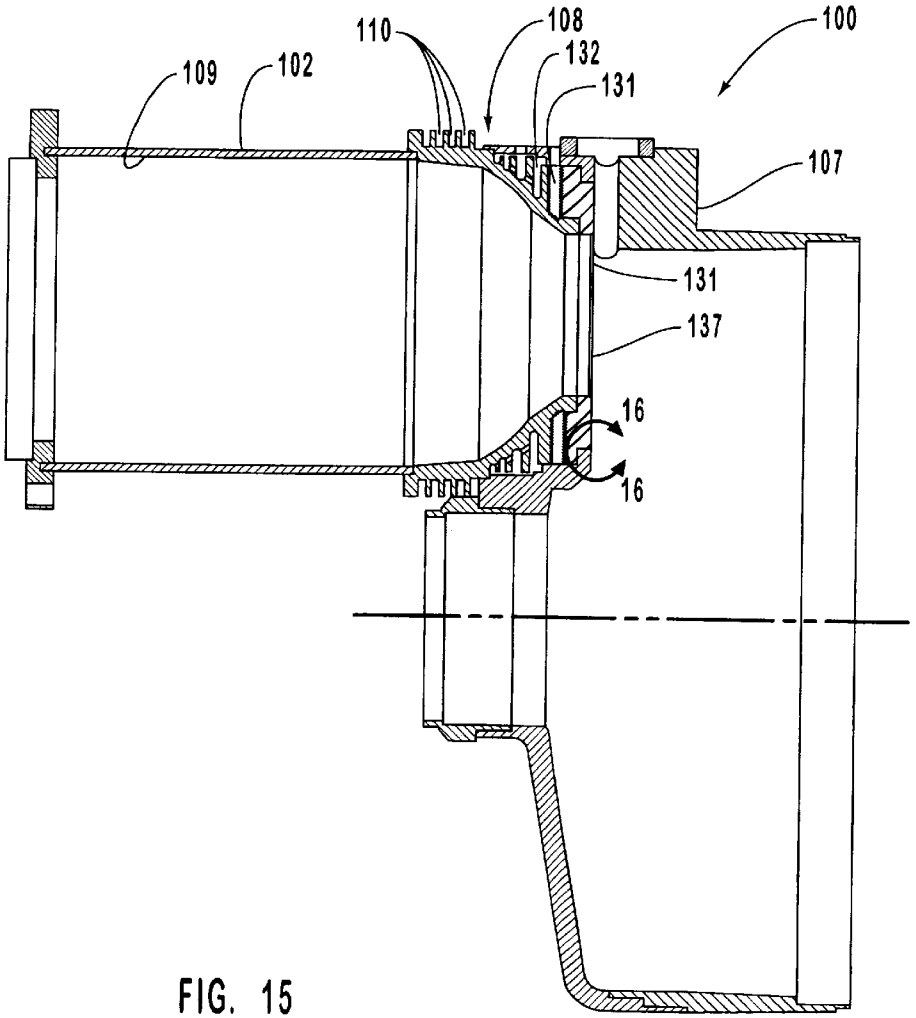
FIG. 15 is a cross-section view of a cathode cylinder, shield assembly, and can.

FIG. 15 is a simplified view of a cathode cylinder 102 affixed to a shield structure 108 and aperture disk 137, which is in turn affixed to can 107. FIG. 16 is a section view taken along lines 16—16 in FIG. 15, which illustrates one presently preferred embodiment of the brazejoint between the can 107 and the aperture disk 137. As is shown, the aperture disk 137 includes a shoulder region 350 that projects outwardly around the aperture disk 137 periphery. The can 107 includes a correspondingly shaped shoulder region 352 that mates with that of the aperture disk 137. In particular, it is shown how the two shoulder regions together form a horizontal mating region at 402, as well as a vertical mating region 400. These two regions can be brazed together. The arrangement is particularly advantageous in that it decreases the stresses between the aperture disk 137 and the can 107 by factors of six or more in preferred embodiments, when compared to joint arrangements having a braze only along a horizontal surface. As such, the improved braze joint better resists stresses associated with the extreme temperatures of the x-ray tube, resulting in a device that is less subject to failure and that provides a longer overall operational life.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States LETTERS PATENT is:

1. An x-ray tube comprising:

(a) a cathode cylinder having an electron source disposed therein;

(b) an x-ray tube housing having an anode disposed therein, the anode having a target surface capable of receiving electrons emitted by the electron source;

(c) a shield structure positioned between the cathode cylinder and the x-ray tube housing, the shield structure defining an aperture through which the electrons are passed from the electron source to the target surface; and (d) at least one fluid passageway disposed proximate to the shield structure, so that at least some heat from the shield structure is absorbed by the coolant as the coolant passes through the at least one fluid passageway, and wherein at least one depression is defined in at least one surface of the at least one fluid passageway and is at least partially in contact with the coolant, the at least one depression facilitating nucleate boiling of the coolant in the at least one fluid passageway.

2. The x-ray tube according to claim 1, wherein at least one surface of the at least one fluid passageway comprises a plurality of extended surfaces being at least partially in contact with the coolant passing through the at least one fluid passageway, and the plurality of extended surfaces being oriented so that heat is transferred from the shield structure to the coolant.

3. The x-ray tube according to claim 1, further comprising an aperture disk that cooperates with the shield structure to at least partially define the at least one fluid passageway, a surface of the aperture disk comprising a plurality of extended surfaces being at least partially in contact with the coolant passing through the at least one fluid passageway, and the plurality of extended surfaces on the aperture disk being oriented so that heat is transferred from the shield structure to the coolant.

4. The x-ray tube according to claim 1, further comprising an aperture disk that cooperates with the shield structure to at least partially define the at least one fluid passageway, a surface of the aperture disk defining at least one depression in contact with the coolant, the at least one depression facilitating nucleate boiling of the coolant in the at least one fluid passageway.

5. The x-ray tube according to claim 1, wherein the at least one depression comprises at least one microgroove.

6. The x-ray tube according to claim 5, wherein the at least one microgroove has a substantially "V" shaped cross section.

7. The x-ray tube according to claim 1, wherein the at least one fluid passageway permits coolant to flow through a first section and a second section of the shield structure, and in a manner so that heat is transferred away from the first section at a greater rate than in the second section.

8. The x-ray tube according to claim 1, wherein the shield structure is affixed to the x-ray tube housing with a braze material placed along a joint formed along both a horizontal and a vertical surface of the shield structure and the x-ray tube housing.

9. The x-ray tube according to claim 1, further comprising a plurality of extended surfaces disposed on an outer surface of the shield structure, the plurality of extended surfaces being at least partially in contact with the coolant that has passed through the at least one fluid passageway, and the plurality of extended surfaces being oriented so that heat is transferred from the shield structure to the coolant.

10. The x-ray tube according to claim 9, wherein the plurality of extended surfaces disposed on the outer surface of the shield structure are formed integrally with the shield structure.

11. The x-ray tube according to claim 9, furthur comprising a fluid flow conduit that directs at least a portion of the coolant that has passed through the at least one fluid passageway directly across at least a portion of the plurality of extended surfaces disposed on the shield structure so that heat is transferred from the extended surfaces to the directed coolant.

12. The x-ray tube according to claim 9, wherein the shield structure and the extended surfaces disposed thereon are comprised of an aluminum oxide dispersion strengthened copper alloy.

13. The x-ray tube according to claim 1, wherein the at least one fluid passageway is formed as a fluid passageway that defines at least two fluid pathways within a bottom section of the shield structure.

14. The x-ray tube according to claim 13, wherein the two fluid pathways are formed by matingly attaching a main body portion of the shield structure to an aperture disk.

15. The x-ray tube according to claim 1, wherein the at least one fluid passageway is formed as a fluid passageway formed within a side of the shield structure.

16. The x-ray tube according to claim 15, wherein the fluid passageway formed within the side of the shield structure is formed between adjacent heat dissipation elements formed about the outer periphery of the shield structure when the shield structure is operably affixed to the x-ray tube housing.

17. The x-ray tube according to claim 1, wherein the at least one fluid passageway comprises at least one fluid passageway formed within a bottom section of the shield structure, and at least one fluid passageway formed within a side of the shield structure.

18. The x-ray tube according to claim 17, wherein the fluid passageway formed within the bottom section of the shield structure, and the fluid passageway formed within the side of the shield structure are in fluid communication with each other.

19. An x-ray tube cooling system comprising:

(a) a reservoir containing coolant that is continuously circulated through the reservoir by an external cooling unit;

(b) a shield structure defining an aperture that allows electrons to pass from an electron source to a target anode and that prevents electrons that rebound from the target anode from re-striking the anode target;

(c) a coolant manifold having an inlet and an outlet port, the inlet port receiving coolant from the cooling unit;

(d) at least one fluid passageway defined at least partially by the shield structure, wherein the at least one fluid passageway receives coolant from the inlet port and discharges the coolant at the outlet port, the coolant absorbing heat from the shield structure as the coolant flows through the at least one fluid passageway; and (e) means for facilitating nucleate boiling of the coolant in the at least one fluid passageway.

20. The x-ray tube cooling system according to claim 19, wherein the means for facilitating nucleate boiling of the coolant in the at least one fluid passageway comprises at least one depression defined in at least one surface of the at least one fluid passageway, and the at least one depression being in contact with the coolant in the at least one fluid passageway.

21. The x-ray tube cooling system according to claim 20, wherein the at least one depression comprises at least one microgroove.

22. The x-ray tube cooling system according to claim 20, wherein the at least one depression has a substantially "V" shaped cross section.

23. The x-ray tube cooling system according to claim 19, further comprising a plurality of extended surfaces disposed on at least one surface of the at least one fluid passageway, the plurality of extended surfaces being at least partially in contact with the coolant directed through the at least one fluid passageway by the inlet port, and the plurality of extended surfaces being oriented so that at least some of the heat in the shield structure is transferred from the shield structure to the coolant passing through the at least one fluid passageway.

24. The x-ray tube cooling system according to claim 23, wherein the plurality of extended surfaces comprises a plurality of microridges.

25. The x-ray tube cooling system according to claim 23, wherein each of the plurality of extended surfaces has a substantially "V" shaped cross section.

26. The x-ray tube cooling system according to claim 19, further comprising a plurality of adjacent extended fin surfaces that are disposed about the outer periphery of the shield structure, and wherein the outlet port directs at least a portion of the coolant passed through the at least one fluid passageway to flow across the surfaces of the fins, and thereby increase the rate of heat transferred from the shield to the directed coolant.

27. The x-ray tube cooling system according to claim 19, wherein the at least one fluid passageway permits coolant to flow through a first and a second section of the shield structure, and in a manner so that heat is transferred away from the first section at a relatively greater rate than from the second section.

28. The x-ray tube cooling system according to claim 27, wherein the length of the fluid passageway in the first section is relatively shorter in length than the fluid passageway of the second section so that the rate of fluid flow through the first section is relatively greater than rate of fluid flow through the second section.

29. The x-ray tube cooling system according to claim 27, wherein the cross-sectional flow area of the fluid passageway in the first section is greater than the cross-sectional flow area of the fluid passageway in the second section so that the rate of fluid flow through the first section is relatively greater than the rate of fluid flow through the second section.

30. A method for cooling at least a shield structure portion of an x-ray tube comprising the following steps:

(a) providing at least a first fluid path and a second fluid path through a corresponding fluid passageway defined at least partially by the shield structure;

(b) directing a liquid coolant through an inlet to the first and the second fluid paths;

(c) causing nucleate boiling of at least a portion of the liquid coolant in the fluid passageway;

(d) discharging the liquid coolant from an outlet connected to the first and the second fluid paths;

(e) directing at least a portion of the discharged liquid coolant across a plurality of extended fin surfaces formed on an outside surface of the shield structure;

(f) circulating the liquid coolant through a cooling unit; and (g) repeating steps (b) through (f).

31. The method according to claim 30, wherein the rate of liquid coolant flow through the first fluid path is greater than the rate of liquid coolant flow through the second fluid path.

32. In an x-ray generating apparatus comprising an evacuated envelope at least partially disposed within a reservoir containing coolant, and the envelope having mounted therein an electron source for generating an electron beam and a spaced apart rotatable anode target for receiving at least a portion of the electron beam, a shield assembly disposed between the electron source and the anode target, the shield assembly comprising:

(a) a shield structure defining an aperture therein for allowing the electron beam to pass from the electron source to the anode target;

(b) an electron collection surface disposed about the aperture and oriented in a manner so as to face the electron source; and (c) an aperture disk, the aperture disk cooperating with the shield structure to at least partially define at least one fluid passageway so that coolant flowing through the at least one fluid passageway absorbs at least some heat from the shield assembly, and at least one depression being defined in at least one surface of the at least one fluid passageway and being in contact with the coolant so as to facilitate nucleate boiling of the coolant flowing through the at least one fluid passageway.

33. The shield assembly according to claim 32, wherein the at least one depression comprises at least one microgroove of substantially "V" shaped cross section.

34. The shield assembly according claim 32, further comprising a plurality of extended surfaces disposed on at least one surface of the at least one fluid passageway, the plurality of extended surfaces being at least partially in contact with the coolant as it flows through the at least one fluid passageway.

35. The shield assembly according to claim 34, wherein the plurality of extended surfaces comprise a plurality of microridges each having a substantially "V" shaped cross section.

36. The shield assembly according to claim 32, wherein the shield structure is affixed to the evacuated envelope with a braze material placed along a joint formed along both a horizontal surface and a vertical surface of the main body portion and the evacuated envelope.

37. The shield assembly according to claim 32, wherein the at least one fluid passageway permits coolant to flow through a first section and a second section of the main shield structure, and in a manner so that heat is transferred away from the first section at a relatively greater rate than from the second section.

38. The shield assembly according to claim 32, further comprising a plurality of extended cooling surfaces disposed about the outer periphery of the shield structure, the second plurality of cooling surfaces at least partially defining at least a second fluid passageway when the shield structure is affixed to the evacuated envelope, a portion of the coolant circulation through the at least a second fluid passageway to facilitate removal of heat from the shield structure.

39. The shield assembly according to claim 32, further comprising a plurality of adjacent and extended cooling surfaces disposed on an outer surface of the shield structure, the extended surfaces being at least partially in contact with the coolant disposed within the reservoir so that at least a portion of the heat generated at the electron collection surface is transferred to the coolant via the plurality of cooling surfaces.

40. The shield assembly according to claim 39, further comprising a fluid flow conduit that directs at least a portion of the coolant that has been discharged from the at least one fluid passageway across at least a portion of the plurality of extended cooling surfaces, so that heat is transferred from the extended surfaces to the directed coolant.

41. The shield assembly according to claim 39, wherein the shield structure and the plurality of adjacent and extended cooling surfaces are comprised of an aluminum oxide dispersion strengthened copper alloy material.

* * * * *